US006188004B1

(12) United States Patent
Broadmoore

(10) Patent No.: US 6,188,004 B1
(45) Date of Patent: Feb. 13, 2001

(54) APPARATUS AND METHOD FOR COUPLING ELECTRONICALLY STORED MUSICAL PERFORMANCES TO THE TRACKER BAR OF AN AUTOMATIC MUSICAL INSTRUMENT

(76) Inventor: Laurence G. Broadmoore, 908 Glenoaks Blvd., #3, San Fernando, CA (US) 91340

( * ) Notice: Under 35 U.S.C. 154(b), the term of this patent shall be extended for 0 days.

(21) Appl. No.: 08/970,772

(22) Filed: Nov. 14, 1997

(51) Int. Cl.[7] ..... G10F 1/02

(52) U.S. Cl. ..... 84/24; 84/13; 84/31; 84/50; 84/65

(58) Field of Search ..... 84/24, 13, 19, 84/31, 32, 33, 50, 65, 66

(56) References Cited

U.S. PATENT DOCUMENTS

| | | | | |
|---|---|---|---|---|
| 3,585,895 | * | 6/1971 | Cannon | 84/137 |
| 4,191,084 | * | 3/1980 | Von Gunten | 84/136 |
| 4,733,592 | * | 3/1988 | Caulkins | 84/151 |
| 5,081,892 | * | 1/1992 | Broadmore | 84/19 |

* cited by examiner

*Primary Examiner*—William M. Shoop, Jr.
*Assistant Examiner*—Kim Lockett

(57) ABSTRACT

A system for adapting a tracker bar operated automatic musical instrument to play electronically stored performances includes, in one embodiment family, a channel plate member having parallel channels in the upper face. First and second spaced apart holes are provided in each channel. An array of solenoid operated valves individually open and close first holes in the channels in response to energizing signals selectively applied to the solenoid coils. The second holes are oriented to interface with the tracker bar holes so that opening a given solenoid operated valves exposes the corresponding tracker bar hole to atmospheric via the corresponding channel. Left and right adjustable bracket assemblies are adapted to respectively engage the left and right pay-off spool mounting members to juxtapose and maintain the channel plate member in the operating position. A printed circuit solenoid driver assembly is suspended from the lower face of the channel plate member with the solenoids being disposed between and supported by the lower face of the channel plate member and the printed circuit assembly. Additional embodiments for directly interfacing the outputs of solenoid-operated valves to tracker bar holes are disclosed and contemplated.

19 Claims, 19 Drawing Sheets

APPARATUS AND METHOD FOR COUPLING ELECTRONICALLY STORED MUSICAL PERFORMANCES TO THE TRACKER BAR OF AN AUTOMATIC MUSICAL INSTRUMENT

FIELD OF THE INVENTION

This invention relates to the art of automatic musical instruments and, more particularly, to apparatus and a method for coupling pneumatic signals representing electronically stored musical performances to the tracker bar of an automatic musical instrument to eliminate the requirement to employ performance paper rolls while, at the same time, completely preserving the mechanical authenticity of the automatic musical instrument.

BACKGROUND OF THE INVENTION

Roll-operated automatic musical instruments have been used and enjoyed for well over a century. By "roll-operated", it is intended to categorize the type of automatic musical instrument in which a punched paper roll travels from a pay-off spool on which the roll is stored to a take-up spool, passing over a tracker bar in the process to "read" the roll. Such an instrument in the broad class is exemplified by the ubiquitous 88-note (earlier, 65-note) "player piano" and its more sophisticated development, the reproducing piano of which the best known systems in the United States are the Ampico (in "A" and "B" variants), the Duo-Art and the Welte-Licensee. (Reproducing piano roll playing mechanisms, carefully restored and incorporated into a fine piano, are capable of recreating the playing of great artists of the past to an astonishing degree.)

However, numerous other roll-operated musical instruments have been manufactured in the past and have been preserved and restored. These include player organs, nickelodeons, orchestrions, etc. Most of these instruments employ tracker bars which have an array of horizontally spaced (most commonly, but not exclusively, nine holes per inch) holes to "read" the punched holes in a performance roll which define the note or notes to be played at a given instant (as a given note perforation in the paper passes over the corresponding hole in the tracker bar) and, in some instances, such as reproducing pianos, also to specify pedaling, instantaneous volume and other performance and control information. Often, one hole position will serve to define an "end-of-roll" condition to trigger a reroll operation in which the roll is rapidly rewound onto the pay-out spool (which is typically removable to permit playing different performances).

Some heavier-duty automatic musical instruments, such as large orchestrions and some band organs, employ a variant of the performance roll constituting a "book" of heavy, cardboard-like punched pages which are sequentially unfolded, fed across a tracker bar and refolded. However, the principal of operation is the same as that of the previously described performance roll.

In typical operation, a given tracker bar hole is normally covered as the music roll traverses from the pay-out spool to the take-up spool, but may be uncovered from time-to-time by suitably positioned perforations in the roll as the performance proceeds. When the hole is uncovered, atmospheric pressure is admitted into the tracker bar hole which is connected by tubing to the underside of a valve pouch. The valve pouch has a vacuum on its upper side, and the individual cavity beneath a valve pouch receives a vacuum supply from the upper side through a small bleed orifice.

Thus, when a perforation in the moving paper roll uncovers a hole in the tracker bar, the underside of the corresponding pouch changes to atmospheric pressure, and the pouch springs upwardly because of the sudden pressure differential placed across it. This action can be used to throw a valve to, for example, admit vacuum to a striker pneumatic, thus causing it to collapse and, through mechanical coupling to the action of the instrument, play a note. When the perforation in the roll passes the tracker bar hole, it is closed off such that the pouch drops as a result of the bleed admitting vacuum to its underside, and the valve is deactivated.

While some automatic musical instruments operate on pressure rather than vacuum, the principal of selectively admitting atmospheric pressure to the holes of a tracker bar as a performance roll traverses it remains the same. In addition, some automatic musical instrument valves work on a "lock-and-cancel" basis in which exposure of one tracker bar hole fires a valve which remains "on" until exposure of a different tracker bar hole shuts it "off". Again, the relationship of a performance roll's perforations to the tracker bar's holes remains the same.

For a comprehensive survey of pneumatically operated musical instruments, one may refer to *Encyclopedia of Automatic Musical Instruments* by Q. David Bowers (Vestal Press—1972) and *Treasures of Mechanical Music* by Arthur A. Reblitz and Q. David Bowers (Vestal Press—1981). Similarly, for a superior treatment of the technology of such instruments, particularly player and reproducing pianos, reference may be taken to *Player Piano Servicing and Rebuilding* by Arthur A. Reblitz (Vestal Press—1985).

Notwithstanding the enjoyment of listening to a good roll-recorded performance on a fine tracker bar based automatic musical instrument, those skilled in the art are well aware of numerous drawbacks to these systems resulting from the fundamental requirement to use, handle and store the rolls themselves.

First, original rolls are now in the range of 60–90 years old, and most of them are fragile, even unplayable, because the acts of mounting, playing and rewinding a roll can destroy it a single play. As a result, and in accordance with renewed interest in automatic musical instruments which itself has been ongoing for some 40 years, a small industry has been devoted to supplying "recuts"; i.e., modem copies of original performance rolls. Recuts themselves are open to a number of objections. In most instances, the copying procedure has resulted in slight variations in the positions of perforations along the length of a roll resulting in a temporal distortion of the recorded performance. (However, a very few recuts have been made so carefully that no fault can be found on this point.) Then, the thickness of the paper is different, usually thicker, than the original rolls which can result in a subtle distortion in tempo because the diameter of the roll accumulating on the take-up spool (which is driven at a constant rate of revolution) builds up at a different rate than with the original rolls, typically resulting in an unintended increase in tempo of the music as a given performance proceeds. (Again, a very few recuts carefully take this variable into account and use paper of appropriate thickness.)

Second, original rolls in good condition have become very expensive, and recuts themselves are expensive.

Third, even a relatively small collection of rolls takes up considerable storage space.

Fourth, the length of a musical performance which can be recorded on a music roll is decidedly limited, typically to a single musical composition or even a fraction of a longer composition. Some systems permit the use of "jumbo" rolls which can include upwards of twenty minutes of performance from a single roll, but often even the original jumbo rolls were assembled from a plurality of shorter rolls which introduced a serious tempo distortion because of the increased thickness of build up on the take-up spool as a roll progressed. Modern "jumbo" rolls made up of copies of a plurality of original rolls can be particularly offensive because of this reason.

Fifth, while some collectors enjoy the ritual of finding, loading, playing, rewinding and returning to storage each roll, most collectors tire of this process and would gladly enjoy the facility to be able to play electronically recorded rolls on their original automatic musical instruments.

Over the years, various systems have been designed to achieve this end. Typically, solenoid-operated valves have been inserted in each tubing line between the tracker bar and the respective tubing destinations. Electronically recorded rolls (for example, on cassette tapes or compact disks) are then employed with suitable interface electronics to simulate the opening and closing of the individual tracker bar holes as if a roll were playing. However, these systems have been difficult to install, often requiring the services of a professional in the field, and, further, typically require alteration to the original instrument. Still further, if it is desired to move such a system to a different instrument, it must be "deinstalled" (with suitable restoration to the instrument) and then installed in the second instrument with the same difficulty and objections previously noted. Further yet, in some instruments, there is insufficient room to install such a system or insufficient room to effect the installation without spoiling the aesthetics of the instrument.

OBJECTS OF THE INVENTION

It is therefore a broad object of this invention to provide a system for playing electronically stored musical performances, for example, those taken from performance rolls, on a conventional tracker bar operated mechanical musical instrument.

It is a more specific object of this invention to provide such a system that may be easily and quickly mounted to and removed from a tracker bar operated musical instrument without effecting any change or modifications whatever to the instrument.

In another aspect, it is an object of this invention, in an especially preferred family of embodiments, to provide such a system in which, during use, a closure door or other device concealing a spool box compartment may be shut in the same manner as is possible during conventional operation with a performance roll or, in the case of a drawer mounted spool box, the drawer may be closed as with a performance roll.

SUMMARY OF THE INVENTION

Briefly, these and other objects of the invention are achieved by a system for adapting a tracker bar operated automatic musical instrument, which includes a spool box having coaxially aligned left and right members for normally receiving and supporting a pay-off spool containing a performance roll, to play electronically recorded performances. A principal component of the system, in a presently preferred embodiment, is a channel plate member having upper and lower faces and a plurality of parallel channels provided in the upper face. First and second holes are provided spaced apart in each channel and extend from the bottom of the channel to its lower face. An array of solenoid operated valves are adapted to individually open and close the first holes in the channels in response to energizing signal selectively applied to the solenoid coils. Each of the solenoid operated valves, in a presently preferred embodiment, include; a solenoid; a cylindrical chamber defined by a shell of each solenoid (or, alternatively, machined in the lower face of the channel plate member) with one of said first holes opening into said chamber; a vent opening for maintaining the chamber at atmospheric pressure; and an armature disc axially movable between first and second positions in the chamber in response to selective energization of the solenoid, When the armature disc is in the first position (to which it is biased by a spring) the first hole is closed off; when the armature disc in the second position, the first hole is opened to atmospheric. Most or all of the second holes in the channels are mutually spaced and oriented to be axially aligned and individually in fluid communication with corresponding holes in the tracker bar when the channel plate member is juxtaposed in an operating position (in the spool box) with respect to the tracker bar. Left and right adjustable bracket assemblies are adapted to respectively engage the left and right pay-off spool mounting members to juxtapose and maintain the channel plate member in the operating position. Each of the bracket assemblies includes: a mounting tab fixed to and downwardly depending from the left and right sides of the channel plate member; an elongated adjustment arm including a longitudinal slot and an aperture disposed proximate one end of the adjustment arm; a pivot member, such as a threaded stud or screw, for coupling the adjustment arm to the mounting tab through said elongated slot; and a wing nut or the like to semi-permanently fix the position of the adjustment arm with respect to the mounting tab. A printed circuit assembly is suspended (for example, by standoffs) from the lower face of the channel plate member with the solenoids being disposed between and supported by the lower face of the channel plate member and the printed circuit assembly. The printed circuit assembly includes driver circuitry for selectively energizing the solenoid operated valves in response to signals representing a recorded performance received from an external source.

An important principle of the invention is the interface of conduits coupled to solenoid-operated valves at one end and directly to the tracker bar holes at the other end. Thus, other embodiments of the invention are contemplated including those which do not employ a channel plate member. For example, an elastic "boot" containing solenoid-operated valves and internal passages opening into a surface opening directly inline with the tracker bar holes may be fitted directly to the tracker bar.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE PREFERRED EMBODIMENTS

Figure 1:
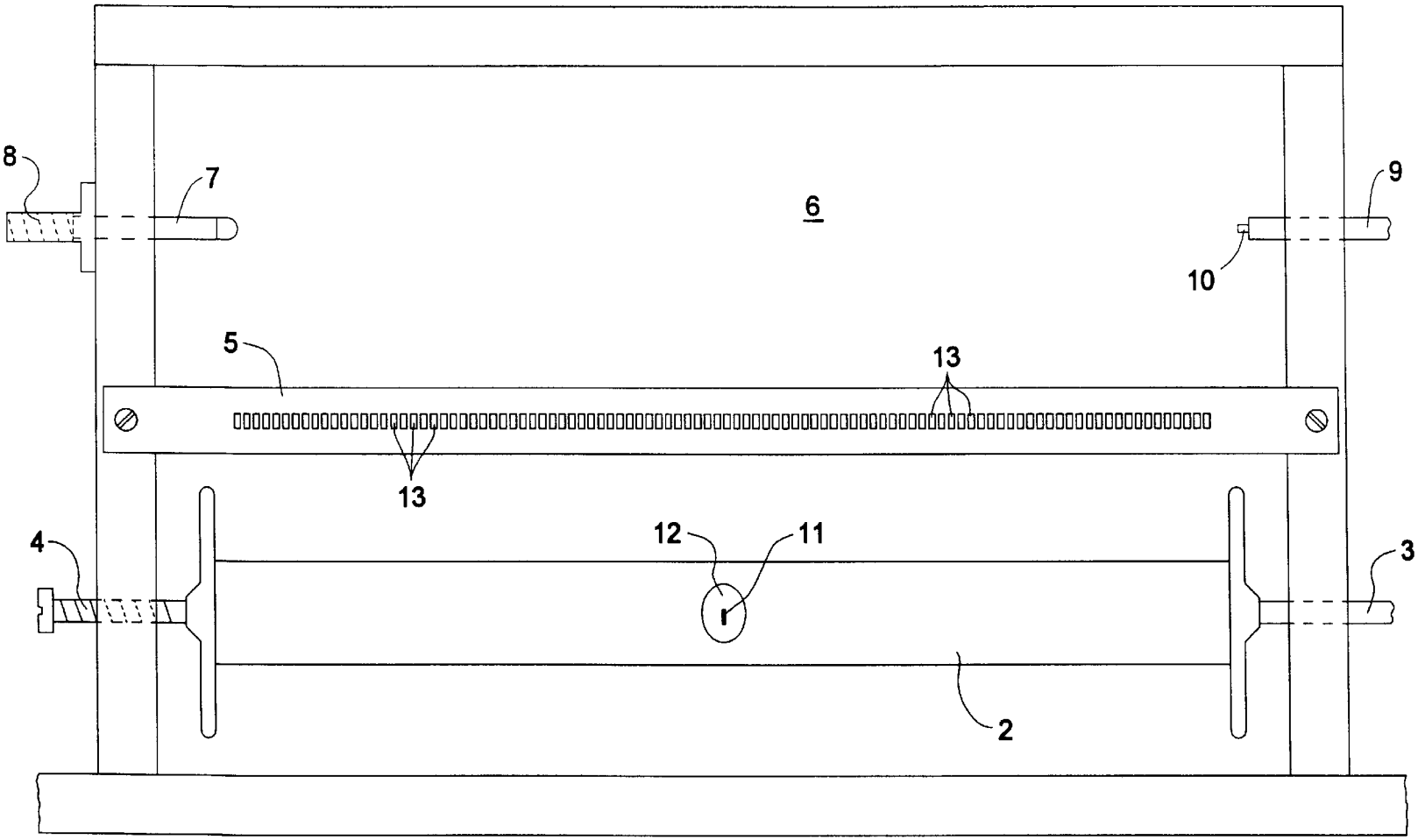
FIG. 1 (PRIOR ART)
FIG. 1 illustrates an exemplary spool box of the type well known in the art and constituting the environment for receiving a principal component of the apparatus of the invention.

Referring first to FIG. 1, there is shown an exemplary prior art spool box 1 which, as will be fully described below, is a suitable environment for receiving a principal channel plate member assembly component of the invention. The spool box 1 houses a take-up spool 2 which is driven from a transmission (typically, wind motor driven), not shown, via a take-up drive shaft 3 which supports one end of the take-up spool, the other end being supported by an adjustable bearing screw 4. A tracker bar 5 is situated above (in the view presented by FIG. 1) the take-up spool 2 and disposed with its axis generally parallel to the axis of the take-up spool. A chamber 6 above the tracker bar 5 is configured to receive a removable paper roll encoded with a musical performance. On the left side of the chamber 6 is a spring loaded, laterally movable bearing member 7 which is biased inwardly by a compression spring 8. On the right side of the chamber 6 is a pay-off drive shaft 9 which is also coupled to the transmission (not shown). The inward end of the pay-off drive shaft 9 is configured as a drive key for engaging a corresponding drive slot in a spool carrying a performance roll. Both the movable bearing member 7 and the drive shaft 9 have rounded ends to couple with corresponding axial sockets at each end of a pay-off spool.

The take-up spool 2 includes a hook 11 positioned at the midpoint of its length and disposed in a depression 12. The conventional purpose of the hook 11 is to couple the take-up spool 2 to a performance roll as will be described below. The tracker bar 5 includes, merely by way of example, 100 aligned rectangular holes 13 equally spaced (typically nine holes per inch) along the length of the tracker bar. The hole configuration shown in FIG. 1 is merely a representation, the various original systems employing diverse configurations which sometimes including elongated slots and/or special purpose holes/slots offset above the alignment of the majority of the holes. Sometimes, roll edge tracking holes are provided on each side of the information holes, but these are irrelevant to the invention and are not shown.

Figure 2:
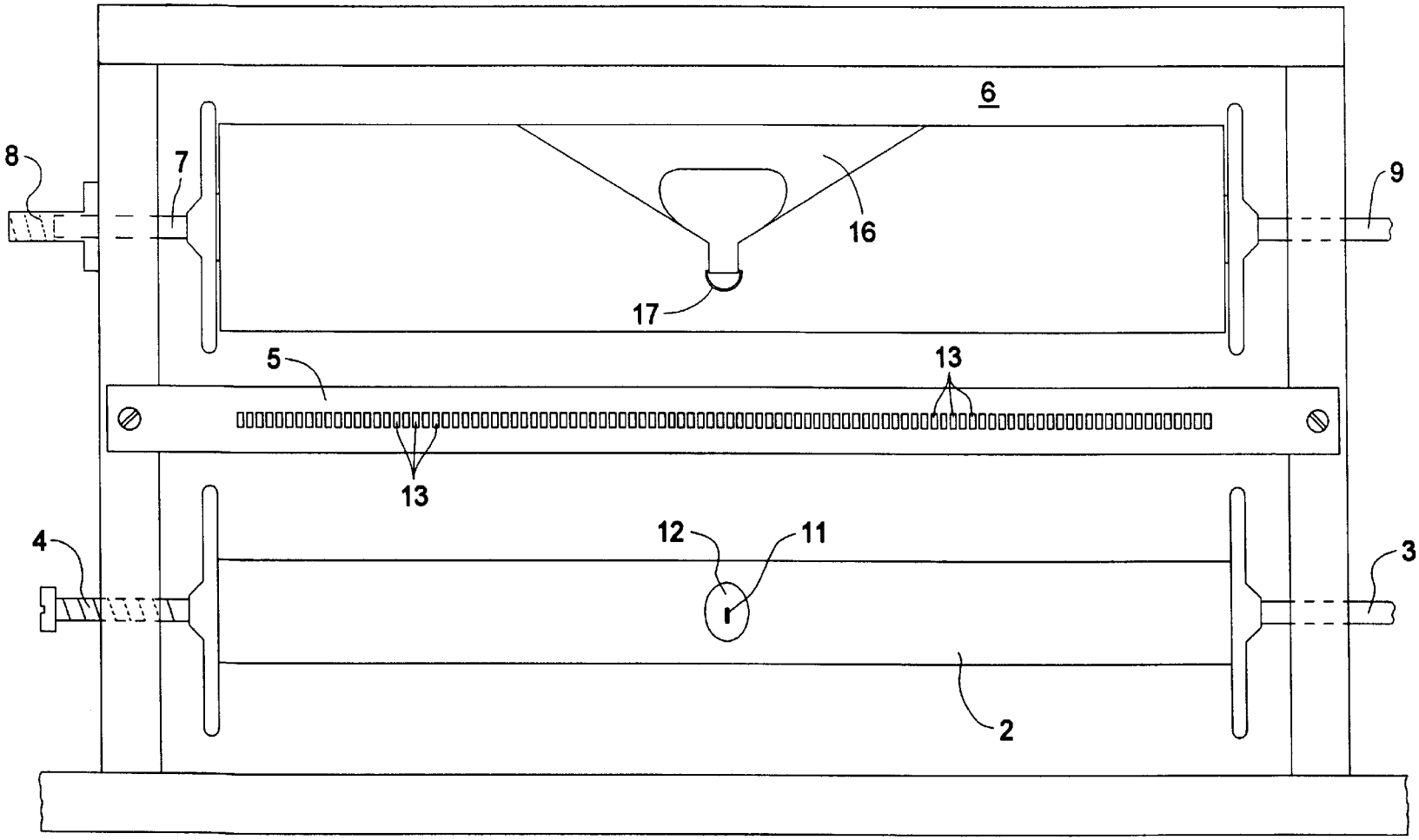
FIG. 2 (PRIOR ART)
FIG. 2 shows the spool box of FIG. 1 with a traditional music performance roll mounted as a pay-off spool.
Figure 3:
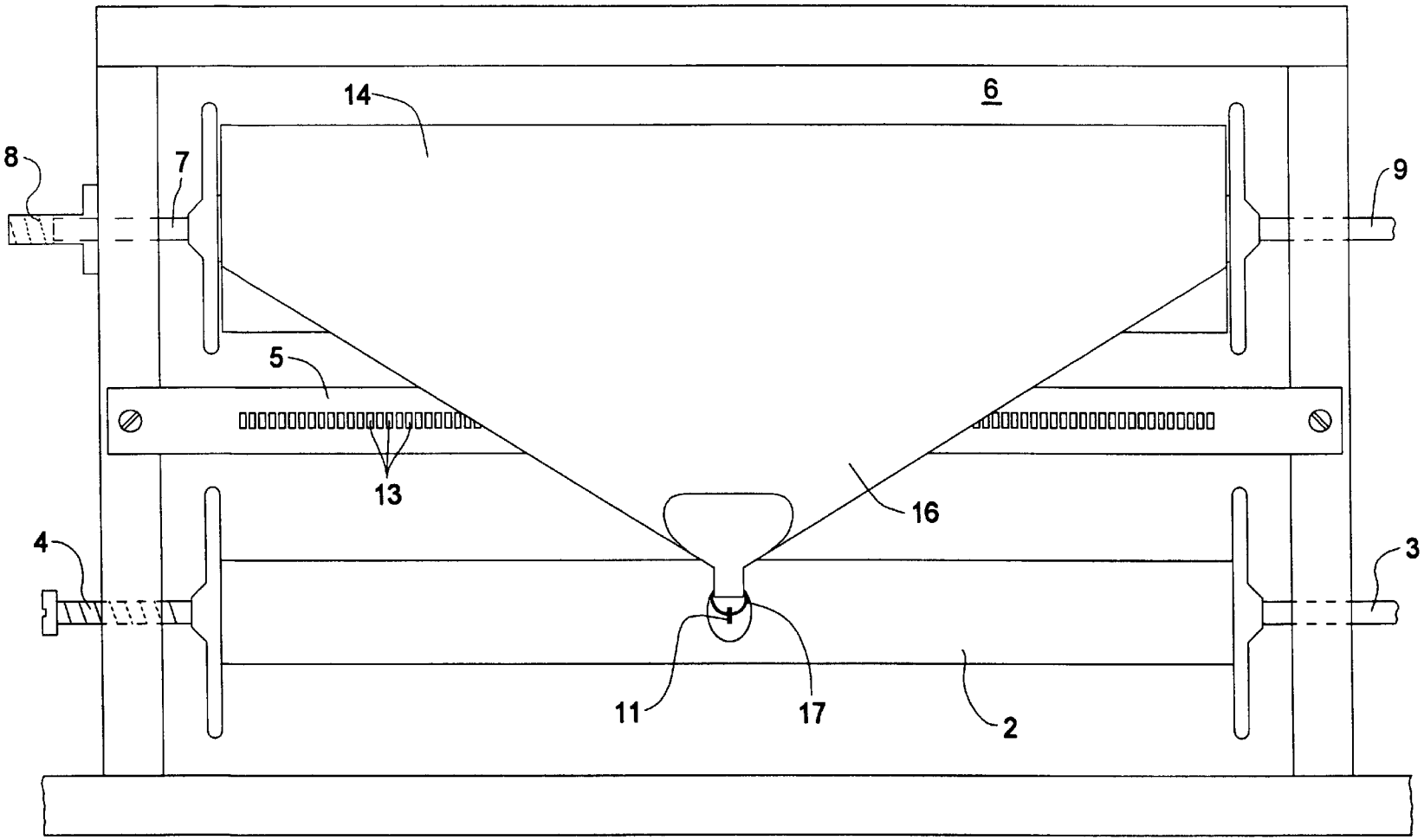
FIG. 3 (PRIOR ART)
FIG. 3 illustrates the manner in which the traditional roll is coupled to a take-up spool prior to playing.

Referring now to the view of FIG. 2, a performance roll 14 has been introduced into the cavity 6 and integrated into the spool box mechanism by engaging the left end of the pay-off spool 15 with the spring-loaded bearing member 7 and then engaging the right end of the pay-off spool with the pay-off drive shaft 9. The compression spring 8 serves to keep the pay-off spool in this fully-engaged position in which the axis of the performance roll is disposed generally parallel to the axis of the take-up spool 2. The roll 14 includes a tapered leader 16 which terminates in a "D" ring 17. FIG. 3 shows the "D" ring 17 engaged with the hook 11 in preparation for playing the roll 14.

Figure 4:
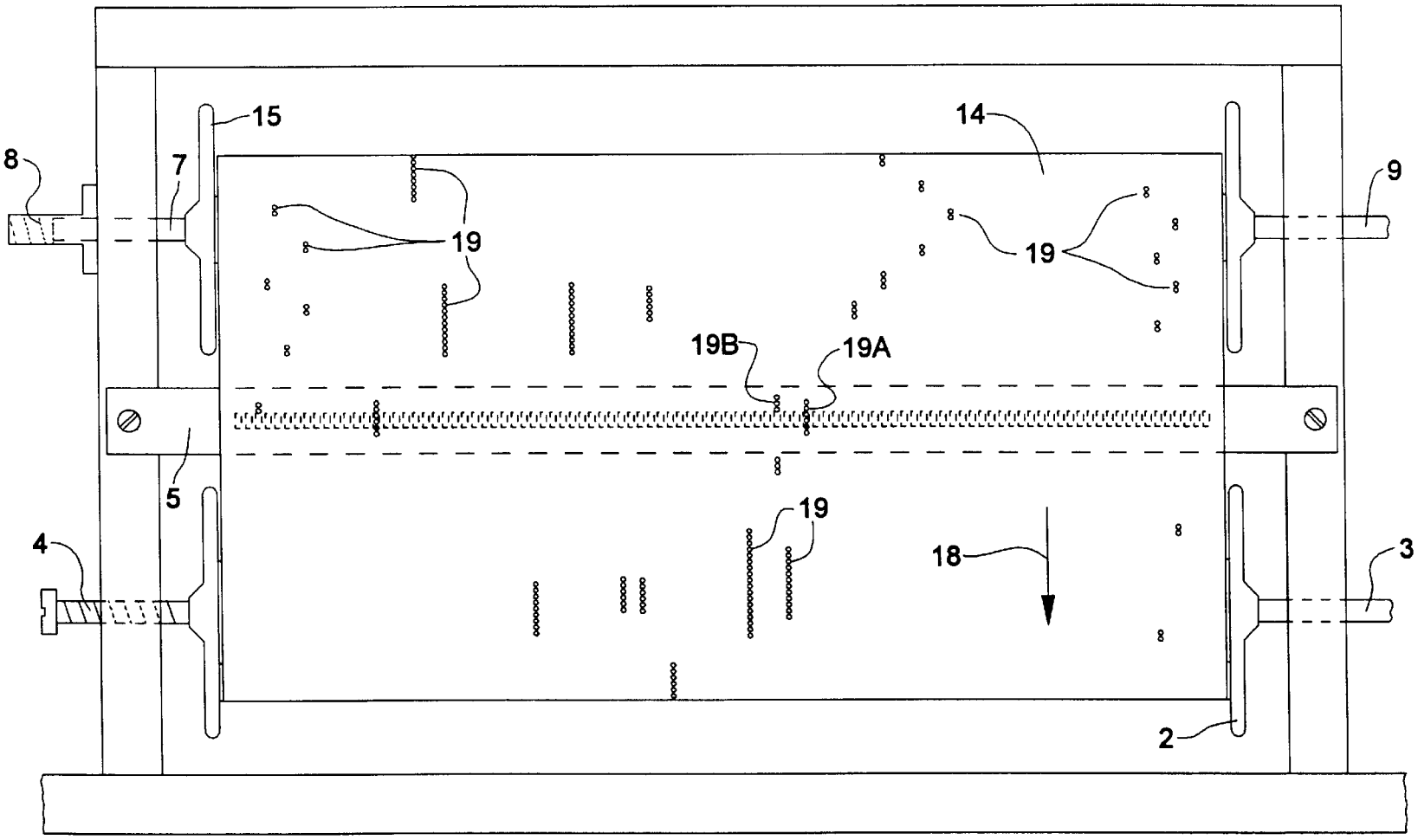
FIG. 4 (PRIOR ART)
FIG. 4 shows the roll during play as it traverses from the pay-off spool to the take-up spool across a tracker bar which reads the holes in the roll.

FIG. 4 illustrates the roll 14 passing across the tracker bar 5 in the direction indicated by the arrow 18, the roll being pulled onto the take-up spool 2 from the pay-off spool 15 as a result of torque delivered to the take-up drive shaft 3 from the transmission (not shown). As the roll 14 traverses the tracker bar 5, the perforations 19 selectively admit atmospheric into the holes in the tracker bar to actuate various note and control valves (not shown) as previously described. For example, note perforation 19A has actuated and continues to hold open a valve (not shown) coupled to the tracker bar hole immediately below that perforation. Similarly, note perforation 19B is just approaching its associated tracker bar hole.

The foregoing discussion provides a suitable understanding of an exemplary environment in which the present invention finds particularly appropriate use, but, as noted above, the invention can be adapted to any tracker bar controlled automatic musical instrument.

Figure 5:
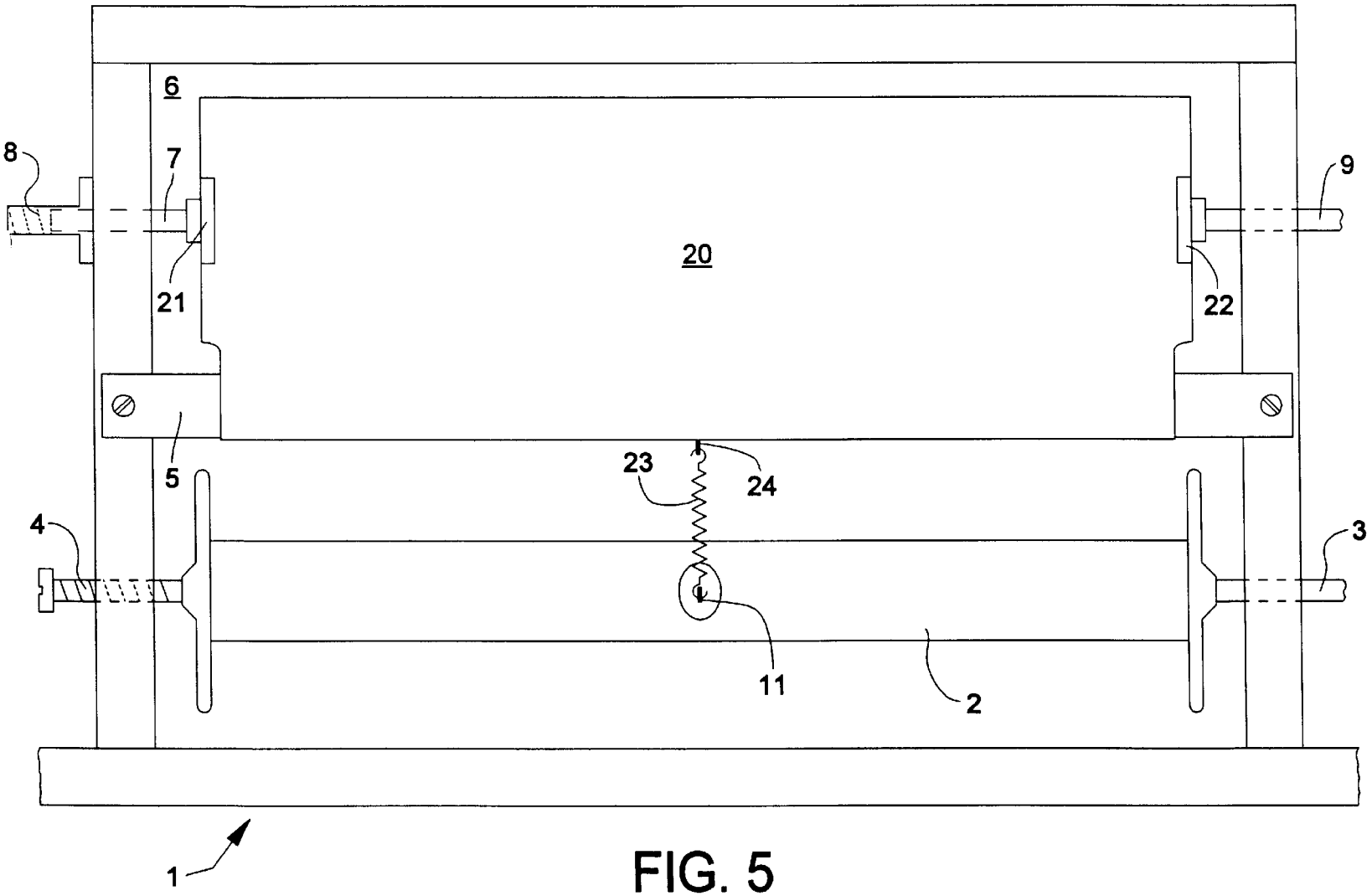
FIG. 5 shows a principal channel plate member assembly component of the invention mounted in the spool box in the place normally occupied by a performance roll on a pay-off spool.

Thus, attention is now directed to FIG. 5 which shows a presently preferred embodiment of the invention installed in a spool box. A channel plate member 20 is readily emplaced in the chamber 6 in a manner similar to mounting a roll. As will be described in detail below, a left side mounting bracket assembly 21 depending downwardly from the channel plate member 20 engages the bearing member 7, and a right side mounting bracket assembly 21 engages the pay-off drive shaft 9 to cooperatively support and correctly position the channel plate member with respect to the tracker bar 5. As will be shown, both the left side and right side mounting bracket assemblies are adjustable for more universal operation among the spool boxes of different brands of automatic musical instruments and to ensure correct lateral and fore-and-aft placement. An extension spring 23 is connected between a spring connection member 24 situated at the center of the forward edge of the channel plate member 20 and the hook 11 of the take-up spool 2 to further secure the placement of the channel plate member with respect to the tracker bar 5 and also to provide a certain amount of positive down force to the channel plate member against the tracker bar.

Figure 6:
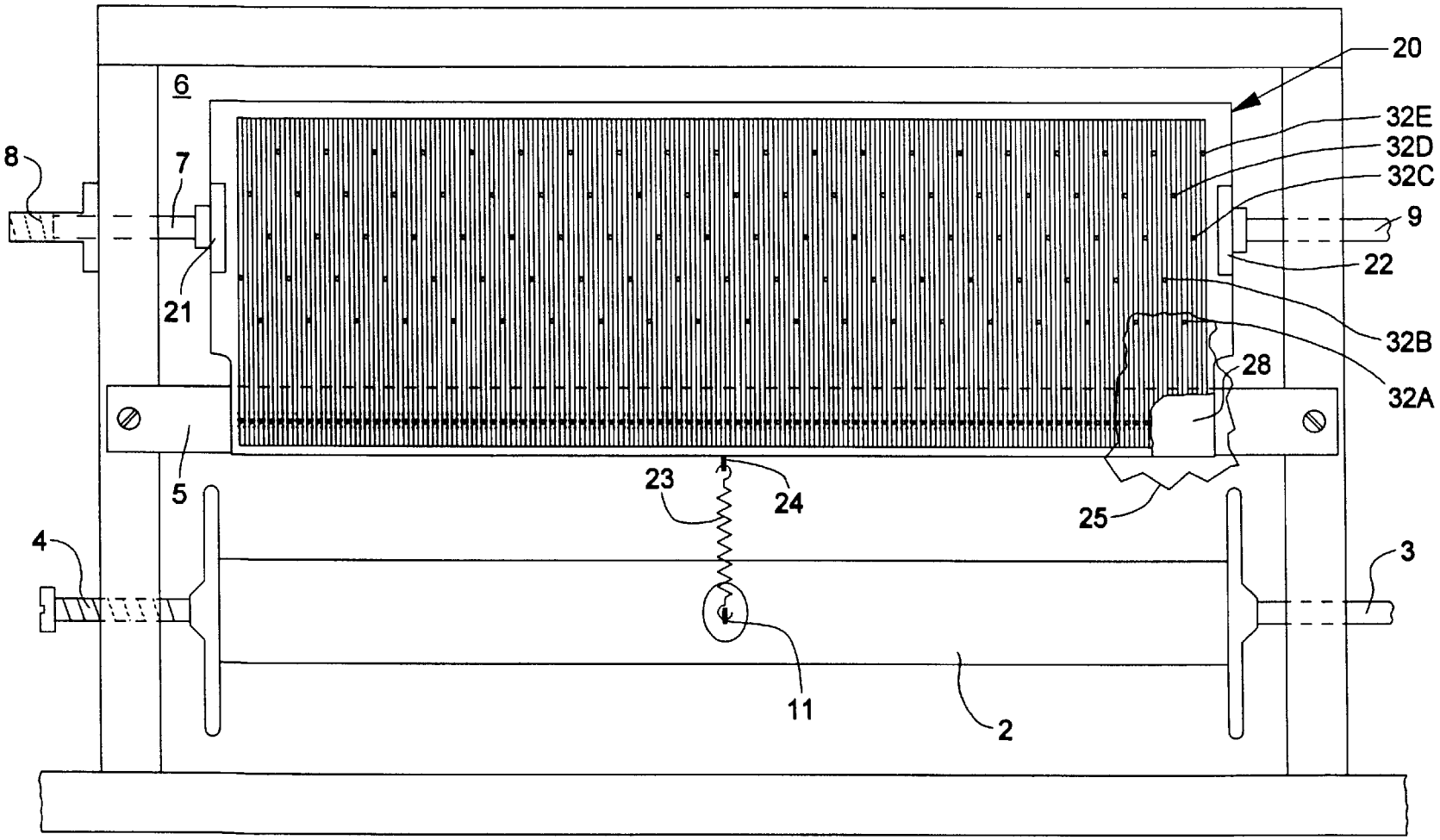
FIG. 6 is a view similar to FIG. 5 with the channel plate member being illustrated with a top cover removed to illustrate the internal structure of the top face.
Figure 7:
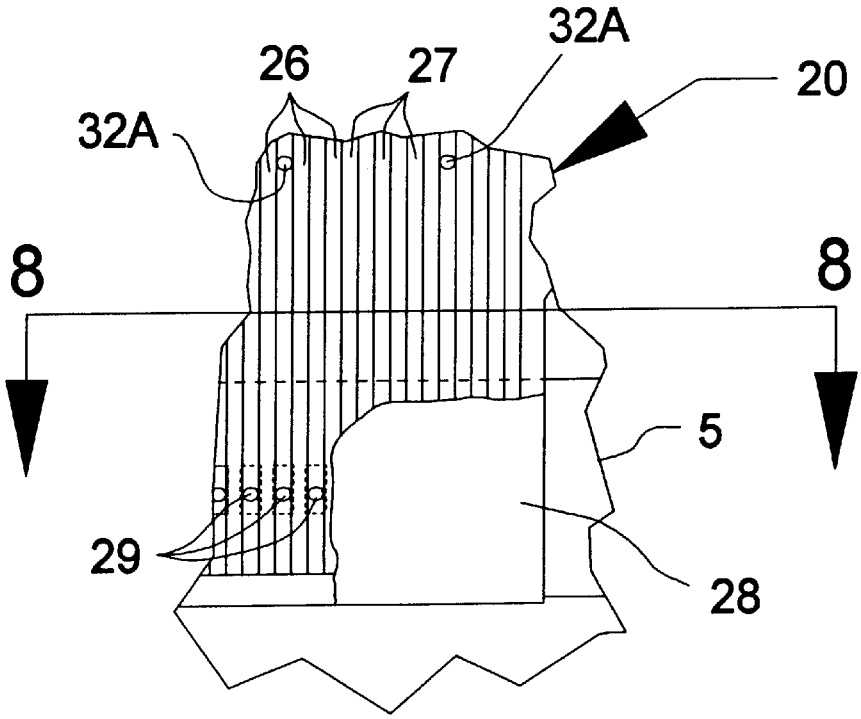
FIG. 7 is an enlarged fragmentary view from FIG. 6 further illustrating details of the structure of the channel plate member and its relationship with the tracker bar.

FIG. 6 is a view similar to FIG. 5 shown with a top cover 28 partially removed to show the internal structure of the upper face of the channel plate member 20. A fragmentary sectional view 25 from FIG. 6 is shown in FIG. 7 to illustrate important detail structure of the channel plate member 20. Thus, referring to both FIG. 7 and FIG. 8, which is a sectional view taken along the lines 8—8 in FIG. 7, it will be seen that the channel plate member 20 includes 100 (in the example) parallel channels 27 separated by parallel dividers 26, the channels and dividers being alternately placed and disposed to run normal with respect to the tracker bar 5 and to the alignment of the tracker bar holes 13.

Figure 8:
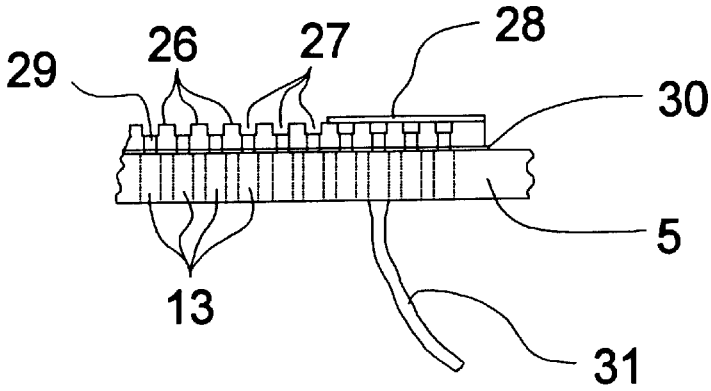
FIG. 8 is a cross sectional view taken along the lines 8—8 of FIG. 7.

Holes 29, one in each channel and normally directed with respect thereto, are aligned and distributed at the same spacing as the tracker bar holes 13 such that, when the channel plate member 20 is correctly installed with respect to the tracker bar 5, each of the holes 29 is individually axially aligned with one of the tracker bar holes 13 as best shown in FIG. 8. In order to ensure substantially air tight interface between the holes 13 in the tracker bar 5 and the holes 29 in the channel plate member 20, a thin, resilient gasket 30 may be provided. Gasket 30, of course, must be provided with properly spaced holes axially aligned with both the holes 29 of the channel plate member and the holes 13 of the tracker bar.

It will be observed that, in the view of FIG. 7, two of the channels 27 have additional holes 32A which are normally directed with respect to the channels. Referring also to FIG. 6, it will be evident that each channel 27, and therefore each hole 29, is in fluid communication with one of the holes 32A, 32B, 32C, 32D and 32E which, for convenience, are disposed in a 5×20 array in the example.

Thus, with the cover 28 in place to isolate the channels from one another and the channel plate member 20 in operative position with respect to the tracker bar 5, if any one or any combination of the holes 32A, 32B, 32C, 32D, 32E are opened to atmospheric, the corresponding holes 29 are also placed at atmospheric via the respective channels 27. Therefore, the individual tracker bar holes 13 are selectively exposed to atmospheric just as if a performance roll were at a given position during a performance. As will be described more fully below, each of the holes 32A, 32B, 32C, 32D, 32E is individually subject to being closed off or open to atmospheric by a solenoid operated valve carried by the channel plate member 20 on the face opposite to that which includes the channels 27.

Figure 9:
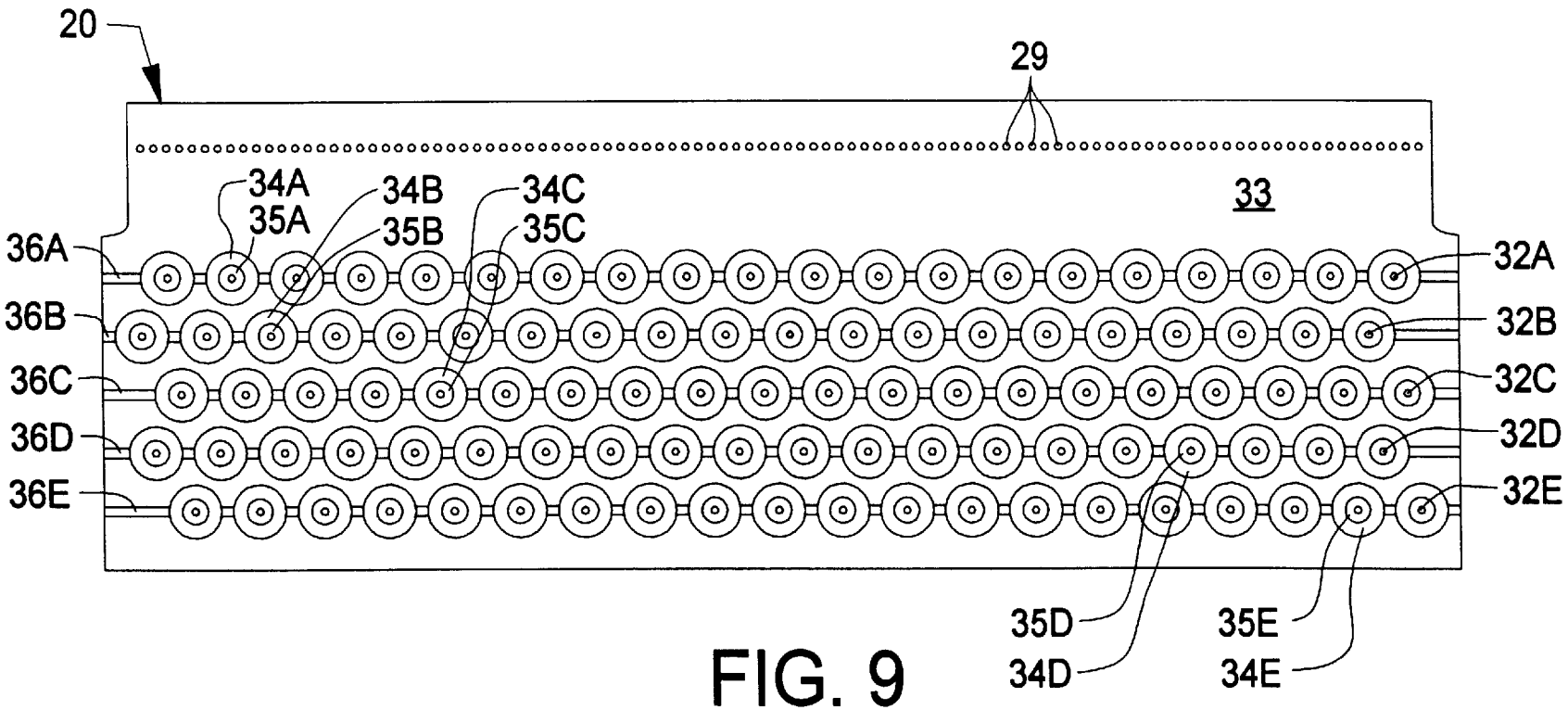
FIG. 9 is a view of the lower face of the channel plate member showing structural details of the machined surface.

For convenience in the description which follows, the side of the channel plate member 20 on which the channels 27 are situated will be called the upper face, and the opposite side will be called the lower face. Thus, attention is now directed to FIG. 9 which shows the lower face 33 of the channel plate member 20 stripped of all solenoid assemblies. Each of the holes 32A, 32B, 32C, 32D, 32E, each of which is individually selectively opened and closed by an associated solenoid, is surrounded by a shallow cylindrical chamber 34A, 34B, 34C, 34D, 34E and a circular, slightly raised area 35A, 35B, 35C, 35D 35E. A transverse channel 36A connects all the chambers 34A together and to atmospheric. Transverse channels 36B, 36C, 36D, 36E perform the same function in the remaining four rows of chambers 34B, 34C, 34D, 34E.

Figure 10:
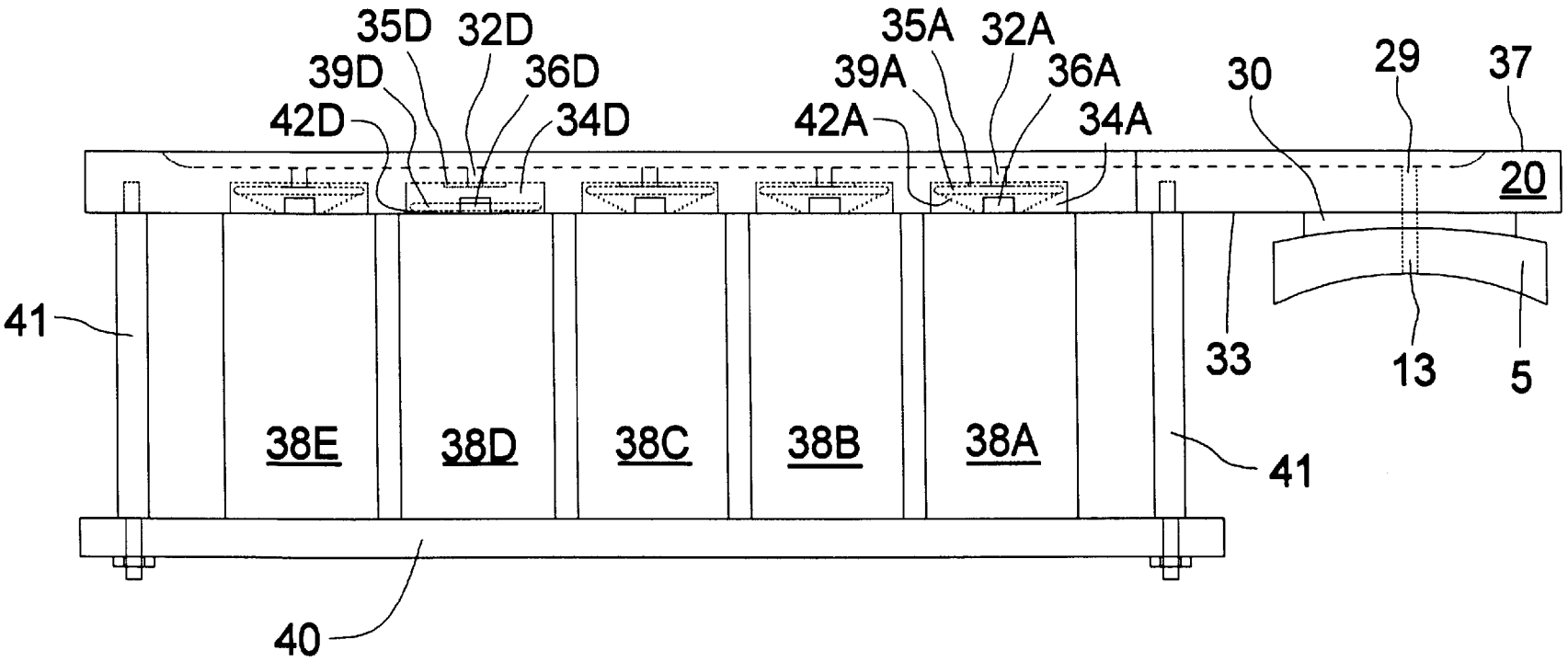
FIG. 10 is a side view of the channel plate member assembly particularly illustrating a first embodiment for solenoid-operated valves employed in the operation of the invention.

FIG. 10 is a left side view of the channel plate member 20 shown with the solenoid rows mounted and the five outboard solenoids 38A, 38B, 38C, 38D, 38E in view. The solenoids are fixed in place between the lower face 33 of the channel plate member 20 and a printed circuit module 40 which is supported from the channel plate member by standoffs 41. Each of the solenoids, 100 of them disposed in a 5—20 array in the example, is coaxially aligned with one of the holes 32A, 32B, 32C, 32D, 32E and operates a valve assembly to selectively admit atmospheric to its associated hole. Thus, referring particularly to solenoid 38A, an armature disc 39A, residing in the chamber 34A, normally closes off its individual hole 32A by virtue of being biased against the raised area 35A by a conical hairspring 42A. However, this condition may be contrasted with the position of the corresponding valve components associated with solenoid 38D which is energized by current from a driver circuit (not shown) through its coil. As a consequence, armature disc 39D has been drawn down by electromagnetic force against the hairspring 42D to open its individual hole 32D and admit atmospheric from channel 36D into it. Therefore, the single channel 27 on the upper face 37 of the channel plate member 20 into which the individual hole 32D opens is placed at atmospheric as is the individual hole 29 in the single channel and also the corresponding individual tracker bar hole 13 to fire the valve (not shown) connected to that tracker bar hole. It will be appreciated that, by selectively energizing the 100 solenoids in a suitable sequence, a performance directly equivalent to that of a music roll may be obtained.

Thus, with the channel plate member 20 configured and mounted to the spool box as described and with the associated solenoids 38 suitably selectively energized, a very effective emulation of a music roll performance is achieved, and the quality of the performance is limited only by quality of the instrument itself and the accuracy of the electronic recording which control the sequence in which the solenoids are energized.

However, the channel plate member 20 is open to the practical drawback of being relatively difficult to fabricate (although a molded component mitigating this problem is contemplated). Taking a number of considerations into account, including assurance of durability and rigidity and even the achievement of a "feel" of quality, the presently preferred materials for fabricating the channel plate member are aluminum and brass, and considerable precision machining is necessary, even though it is possible to extrude (in aluminum) a blank plate which has the channels 29 extruded in and seal the channel ends in any suitable fashion.

Figure 11:
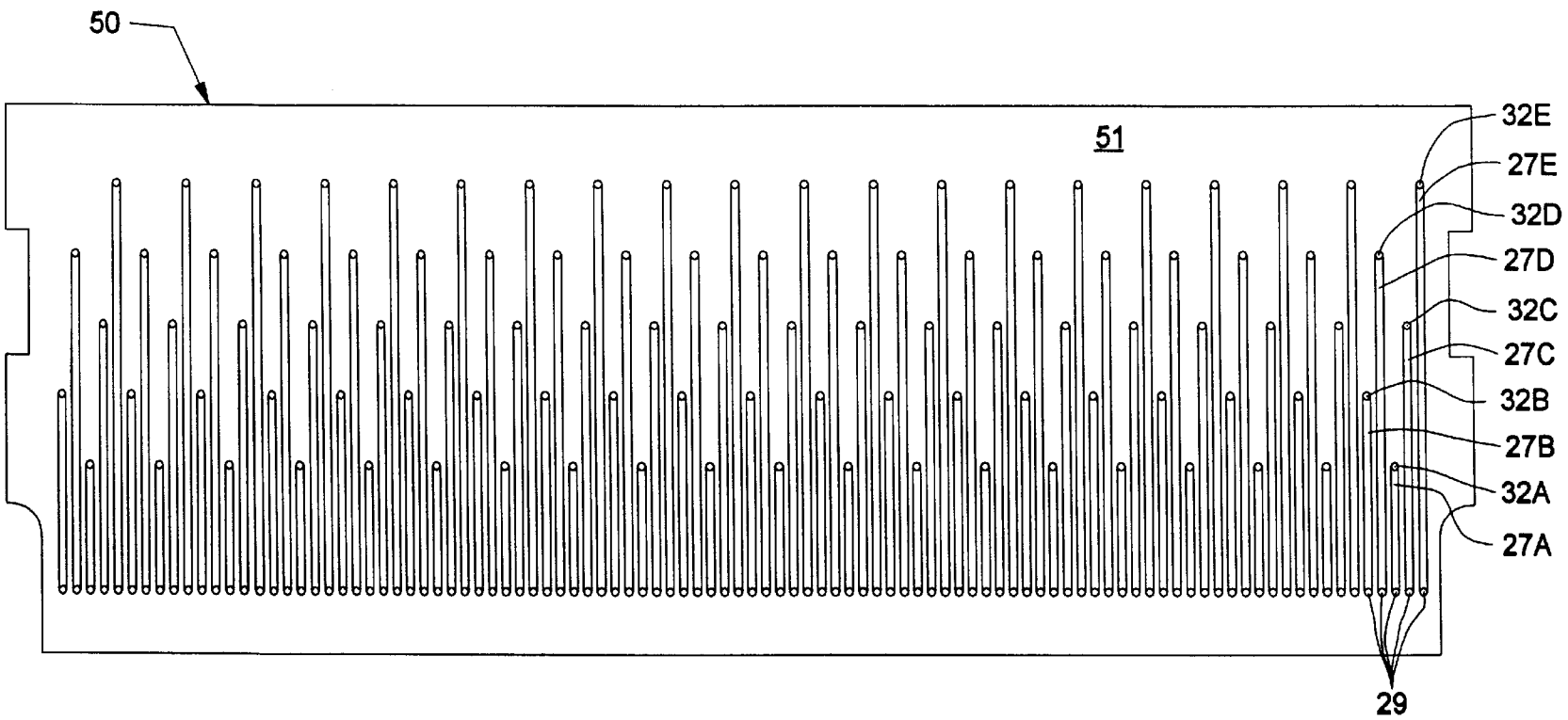
FIG. 11 is a top view of a second embodiment of the channel plate member.

Thus, an alternative, and presently preferred, configuration for a channel plate member is shown in FIGS. 11, 12, 13 and 14. FIG. 11 illustrates the upper face 51 of the channel plate member 50 in which it will be seen that, to limit the linear amount of precision machining required to form the channels 27A, 27B, 27C, 27D, 27E, each channel extends only from its individual hole 29 in the aligned set which interfaces with the tracker bar to its individual hole 32A, 32B, 32C, 32D, 32E which interfaces with the valve components on the lower face of the channel plate member.

Figure 12:
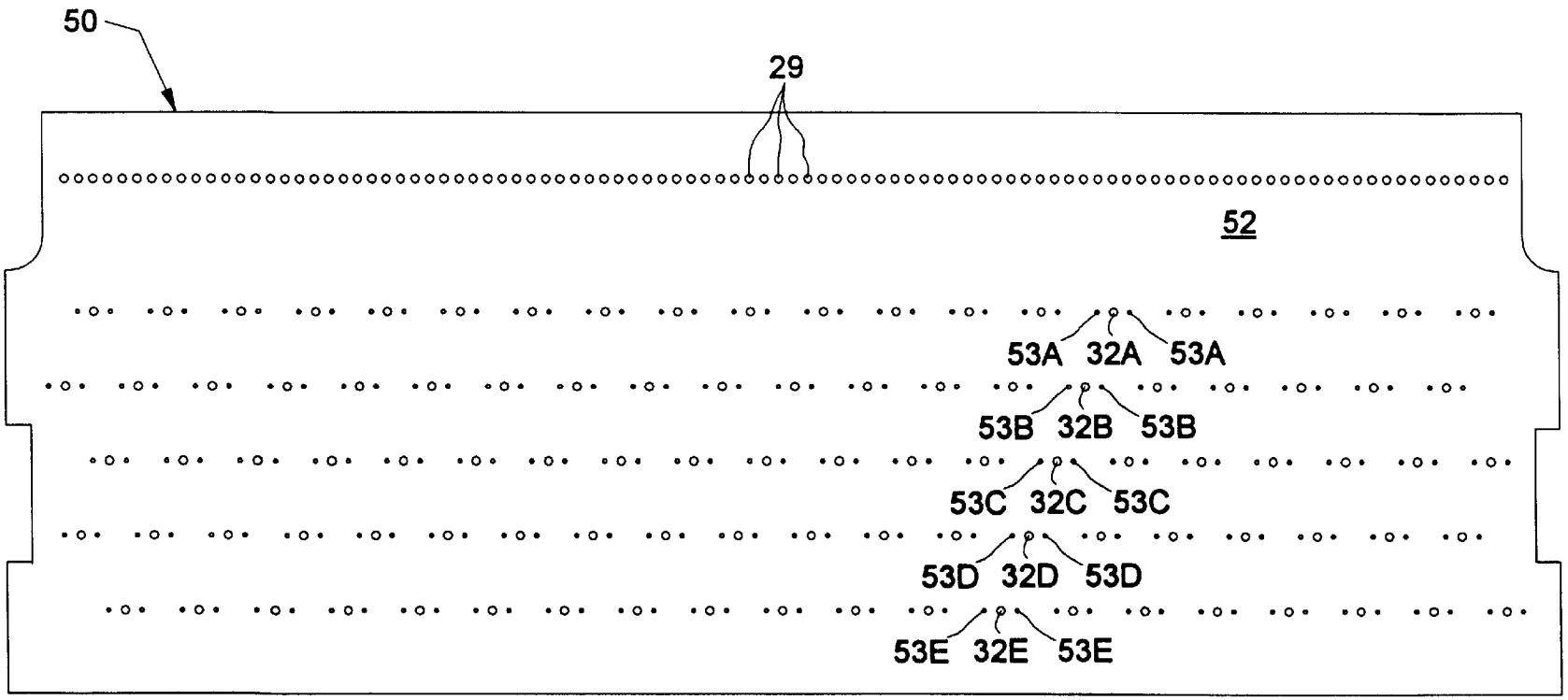
FIG. 12 is a bottom view of the second embodiment of the channel plate member.

Attention is now directed to FIG. 12 which illustrates the lower face 52 of the channel plate member 50. Of particular importance is the fact that there are no machined chambers nor any raised areas surrounding each of the holes 32. Rather, as indicated, for example with respect to one of the holes 32A, each hole 32 in the 5—20 array is provided with a pair of alignment holes 53A, (diametrically opposed in the example) which, as will become more clear below, serve to correctly position each solenoid-operated valve with respect to its hole 32.

Figure 13:
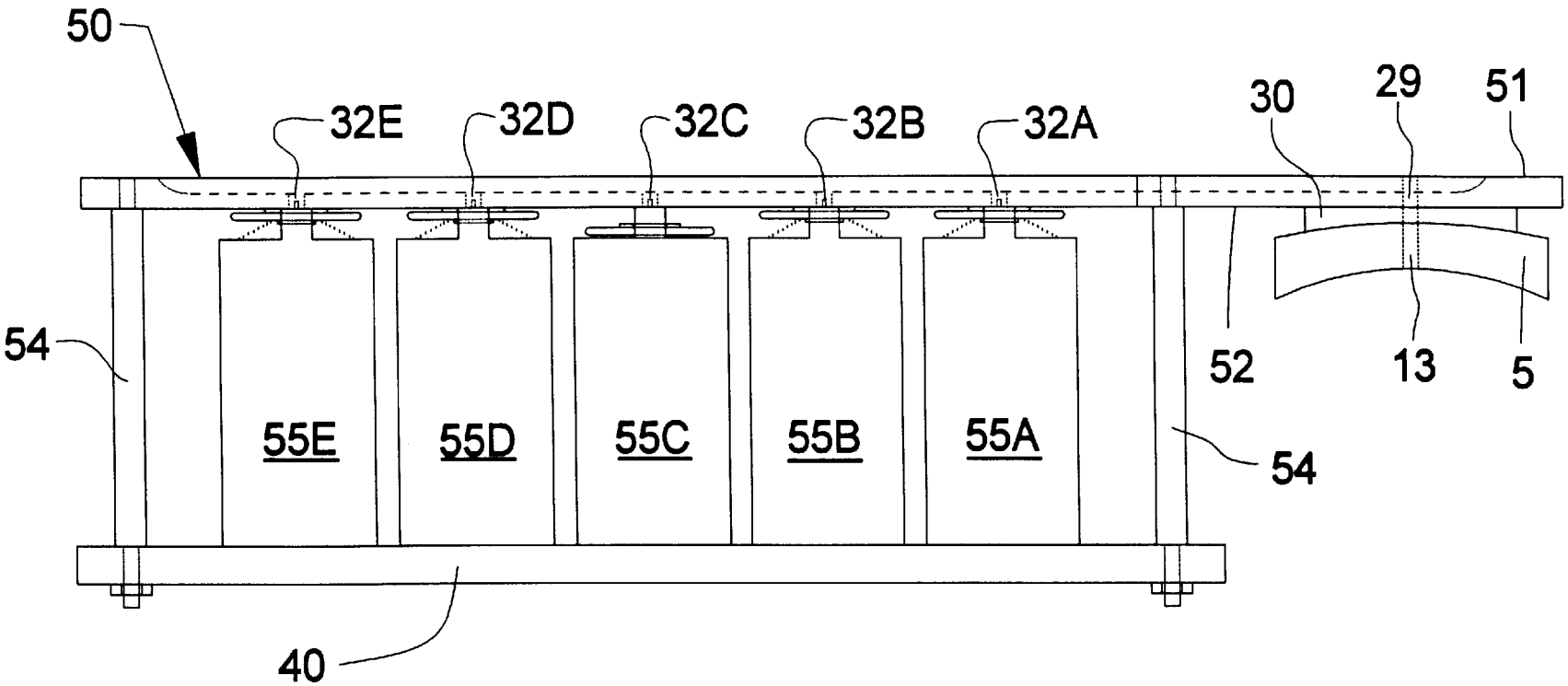
FIG. 13 is a side view of the second embodiment of the channel plate member assembly particularly illustrating a second embodiment for the solenoid-operated valves employed in the operation of the invention.

Thus, referring to FIG. 13 which is a view similar to FIG. 10, five outboard solenoids 55A, 55B, 55C, 55D, 55E are shown fixed between the lower face 52 of the channel plate member 50 and the printed circuit board 40 which is supported from the channel plate member by standoffs 54. It will be noted that the thickness of the channel plate member 50 is substantially reduced with respect to the thickness of the channel plate member 20 previously described. This desirable result is obtained because the regions within which the armatures translate are disposed between the upper ends of the solenoids 55A, 55B, 55C, 55D, 55E and the lower face 52 of the channel plate member 50 rather than in the channel plate member.

Figure 14:
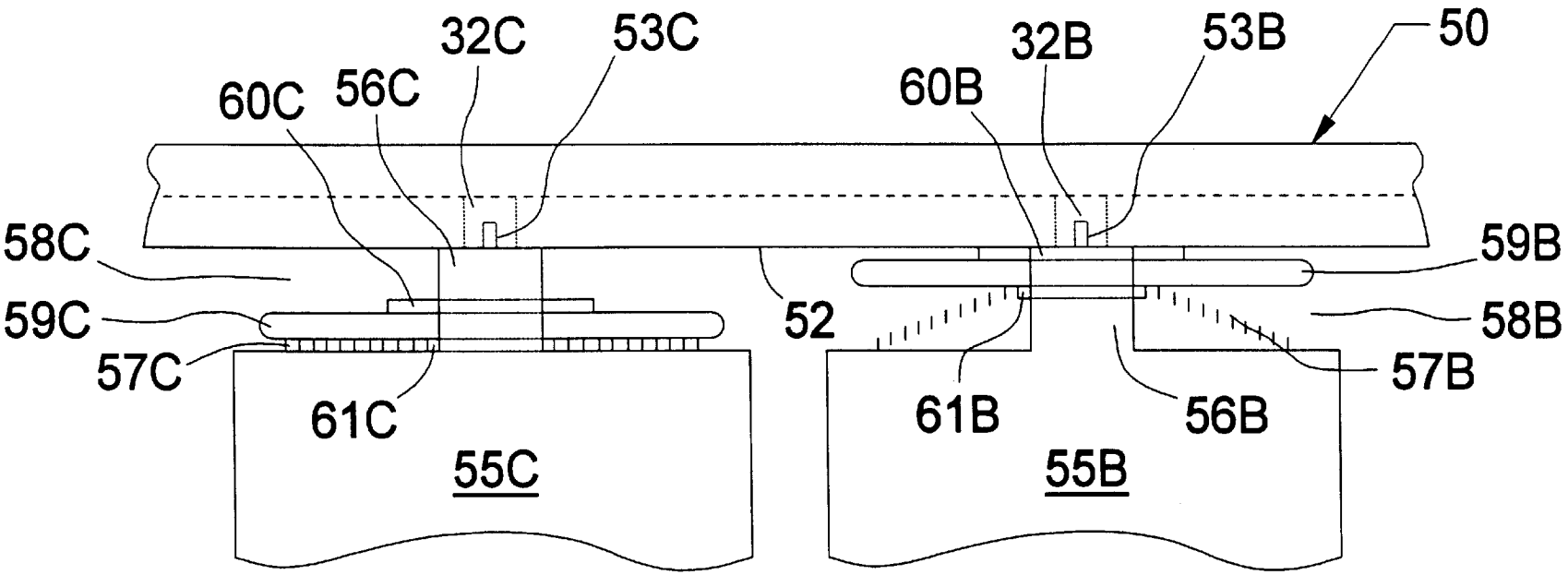
FIG. 14 is an enlarged fragmentary view from FIG. 13 showing more detailed structure for the valve components in the second embodiment.

More particularly, as best shown in FIG. 14, but still also referring to FIG. 13, the region within which armatures 59B, 59C translate is disposed between the upper end of each solenoid (only solenoids 55B and 55C being illustrated in the enlarged view of FIG. 14) and the lower face 52 of the of the channel plate member 50. The region is further defined by a pair of support members (only one support member, 56B, 56C, respectively, being in view in FIG. 14 for each of the solenoid-operated valves 55B, 55C). The solenoid-operated valves 55B, 55C are supported in coaxial alignment with respective holes 32B, 32C by the support members 56B, 56C which have tab ends extending into alignment holes 53B, 53C (see also FIG. 12).The inner coils of the hairsprings 57B. 57C respectively capture raised circular portions 61B, 61C on the lower faces of the armatures 59B, 59C to further insure that they do not move out of place laterally.

Thus, the armatures 59B, 59C each can move between an unenergized position, as with solenoid 55B in which the armature is urged against the lower face 52 of the channel plate member 50 by conical hairspring 57B and an energized position, as with solenoid 55C in which the armature 59C is drawn down against the hairspring 57C (due to the current flowing through the coil of the solenoid 55C). Each armature carries, on its upper face, a thin positive seal member 60B, 60C which may be a disc of valve leather, neoprene, gum rubber or other suitable resilient, long lasting material. Consequently, the hole 32B is sealed off effecting a closed valve whereas the hole 32C is open to the chamber 58C effecting an open valve and admitting atmospheric to its corresponding channel in the upper face 51 of the channel plate member 50, thereby delivering atmospheric to the hole 29 also in the channel and to the aligned tracker bar hole 13.

In addition to the reduction in thickness of the channel plate member 50 compared to the channel plate member 20, the machining operations required to prepare the former are very considerably reduced such that it is much easier and quicker to fabricate and enjoys a more accurate valve configuration.

Figure 17:
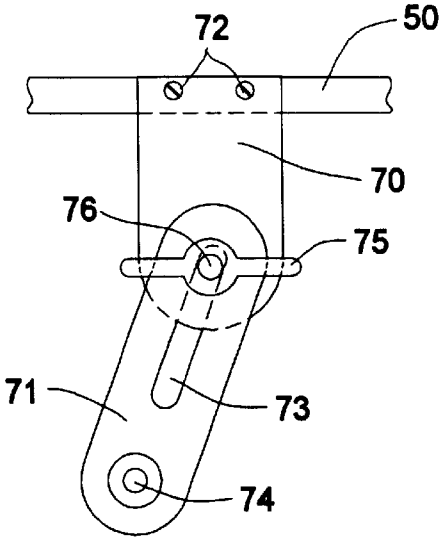
FIG. 17 is a view similar to FIGS. 15 and 16 showing the adjustable mounting bracket assembly adjusted to a third exemplary position.
Figure 16:
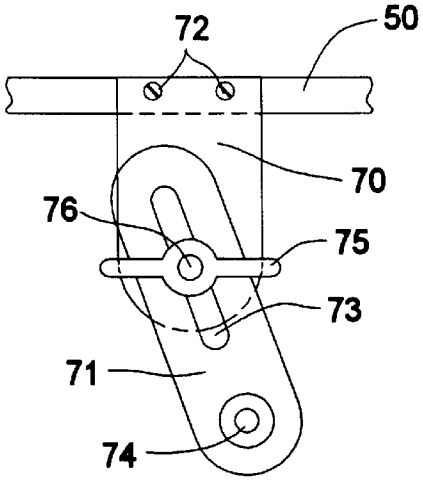
FIG. 16 is a view similar to FIG. 15 showing the adjustable mounting bracket assembly adjusted to a second exemplary position.
Figure 15:
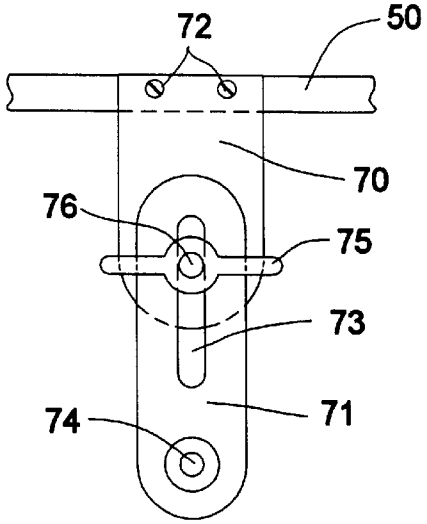
FIG. 15 is a fragmentary side view illustrating an adjustable mounting bracket assembly for facilitating fitting the channel plate member assembly to a variety of spool boxes, the mounting bracket assembly being shown in a first exemplary position.

Attention is now directed to FIGS. 15, 16 and 17 which illustrates a presently preferred configuration for the adjustable mounting bracket assembly which is adaptable to accommodate the channel plate member assembly, including the solenoid array and electronics carried by the printed circuit board, to a suitable range of spool boxes. For example, the embodiment chosen for illustration serves to correctly mount the channel plate assembly to virtually any reproducing piano or player piano spool box and tracker bar designed for playing 11½ inch rolls with nine holes per inch spacing, by far the most common configuration.

The mounting bracket assembly, one for each end of the channel plate member 50, includes a mounting tab 70 which is fixed to the edge of the channel plate member and depends downwardly. (Alternatively, if the channel plate member is cast, the mounting tab 70 may be integral with it.) An elongated adjustment arm 71 is provided with a longitudinal slot 73 which extends from proximate an upper end to somewhat more than half way to the lower end of the adjustment arm. Typical dimensions for the adjustment arm 71 are 2⅜ inches long by ¾ inch wide with the slot 73 being about one inch long. Near the lower end of the adjustment arm, a conical aperture 74 is provided. The diameter of the outer end of the aperture 74 is made sufficient to receive the rounded ends of the pay-off drive shaft 9 and the spring loaded, laterally movable bearing member 7 (FIGS. 1 and 5), and the diameter of the inner end is smaller than the diameters of the drive shaft and bearing member. If desired, a circular, enlarged aperture 74 may be provided along with a set of exchangeable inserts to accommodate a range of diameters for the drive shaft and bearing member which may be encountered in diverse instruments.

The mounting tab 70 is provided with a threaded stud or screw 76 which extends laterally outwardly from near the free or lower end. The adjustment arm 71 is coupled to the mounting tab 70 by introducing the slot 73 over the stud 76 (which functions as a pivot member) and securing the arm in the desired position with, for example, a wing nut 75. With this mounting bracket assembly, a wide range of adjustment is possible as may best be understood by reference to the exemplary positions shown in FIGS. 15, 16 and 17. In FIG. 15, the adjustment arm 71 is situated with the stud 76 placed about ¾ along the length of the slot 73 toward its upper end and more or less aligned with the mounting tab 70. In FIG. 16, the stud 76 is placed about midway along the length of the slot 73 and pivoted somewhat counter-clockwise. In FIG. 17, the stud 76 is situated near the top of the slot 73 and rotated somewhat clockwise. Consequently, the position of the aperture 74 with respect to the mounting tab 70, and hence the channel plate 50, may be adjusted across a wide range which, as previously noted, obtains a correct position for the channel plate 50 with respect to the tracker bar 5 for substantially all spool boxes within the class.

Referring also to FIG. 1, to adjust and mount the channel plate member assembly into a spool box, a preliminary adjustment is made to the adjustable bracket assembly 21 at each end and a trial fit undertaken by engaging the left side aperture 74 with the rounded end of the spring loaded, laterally movable bearing member 7, pushing the bearing member inwardly against the spring bias to provide clearance between the right side aperture 74 and the pay-off drive shaft 9 and then engaging the right side aperture 74 with the rounded end of the pay-off drive shaft. If the channel plate member is found to not correctly align with the tracker bar 5, the channel plate member assembly is removed, suitable adjustments made to the mounting bracket assemblies and the channel plate member remounted. When the correct position of the channel plate assembly with respect to the tracker bar has been obtained, the wing nuts 75 may be fully tightened, and the adjustment need not thereafter be revised until the channel plate member assembly is moved to a different tracker bar. Referring back to FIG. 5, during normal operation, the extension spring 23 is connected between the spring connection member 24 and the hook 11 of the take-up spool 2 to secure the channel plate member assembly in place and to provide slight down force of the channel plate member against the tracker bar.

Figure 18:
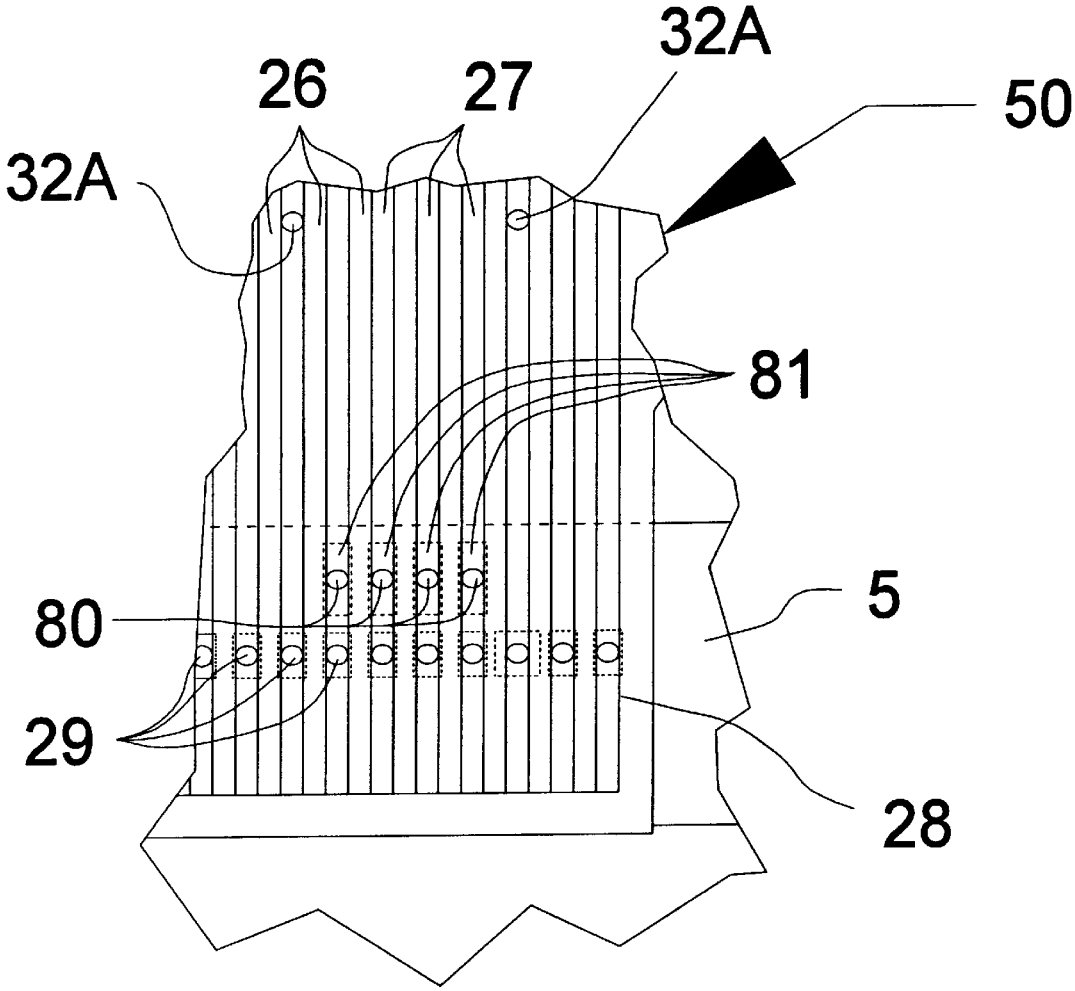
FIG. 18 is a fragmentary view of one end of a tracker bar employing offset holes, the view particularly illustrating the manner in which the channel plate member may be modified to function therewith.

It has previously been noted that some tracker bars have control holes which are offset from the aligned set of note and control holes. For example, referring to FIG. 18 which shows one end of a tracker bar 5D, the tracker bars employed with the Duo-Art reproducing piano system have four adjacent offset elongated control slots 81 feeding offset tracker bar holes disposed beneath and aligned with supplementary holes 80 provided in the channels 27 of the channel plate member 50. It will be noted that the holes in the same channels which are included in the aligned holes 29 are also provided in order that an instrument fitted with the invention can play both Duo-Art and standard 88-note rolls, a standard feature of pianos fitted with the Duo-Art system. As a practical matter, a channel plate member 50 configured at each end as shown in FIG. 18 can be used as a nearly universal unit for nine holes per inch tracker bar systems because the gasket 30 (FIG. 8) and tracker bar upper surface will close off the holes 80 when the unit is used with a system other than Duo-Art.

Figure 19:
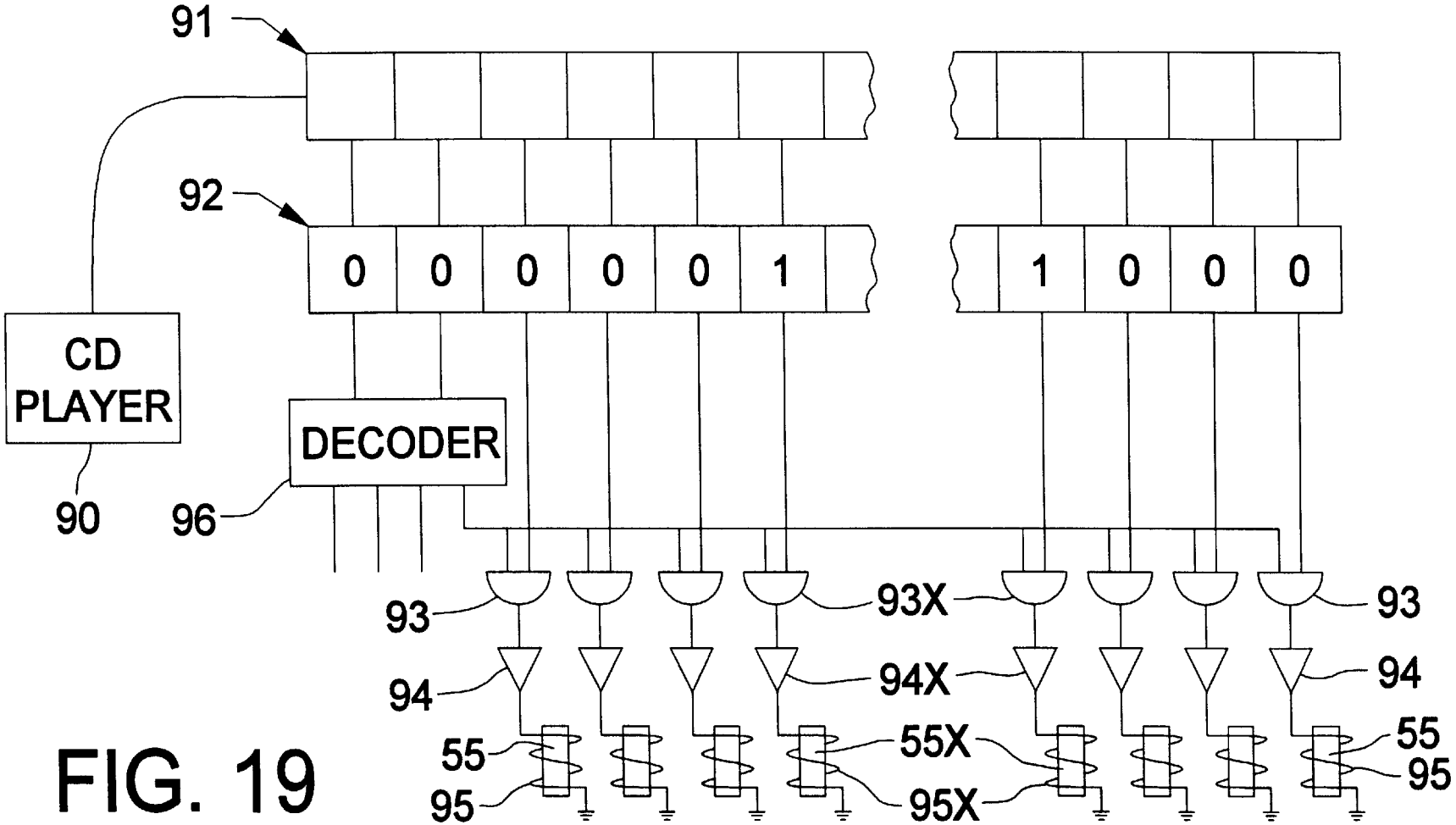
FIG. 19 is a high level block diagram of an exemplary electronics circuit for operating the solenoid-operated valves incorporated into the subject invention from signals received from an external source and which represent a recording of a musical performance roll.

A wide range of circuits, disposed on the circuit board 40, for driving the solenoids 55 (38) systematically to emulate a performance roll traversing the tracker bar may be used with the invention. A high level, generalized block diagram for the solenoid control circuit is shown in FIG. 19. Signals representing a recorded performance (which may have been taken from an original performance roll for the type of instrument or may represent a newly recorded performance) are transferred serially from a playback device, such as compact disc player 90 (or a video or audio cassette, a floppy or hard drive, etc.), to a serial-to-parallel register 91 in repetitive frames of, for example, 128 bits. Typically, frames are supplied to the serial-to-parallel register 91 at a rate of at least 20 frames per second and preferably at a higher rate. When a full frame has been received, the individual bits are immediately transferred in parallel to a latch register 92 in order that that transfer of a succeeding frame can begin.

Each stage of the latch register 92 is used to control the selective energization of an individual solenoid 55. In the example, a logic "1" present in a stage indicates that the corresponding solenoid should be energized to actuate its valve to admit atmospheric into its corresponding channel and hence expose the corresponding tracker bar hole to atmospheric as previously described. The content of each stage of the latch register 92 is applied to one input of an AND-gate 93. The output of each AND-gate 93 is applied to the input of a solenoid driver 94 such that, when a "1" is present in a given stage of the latch register 92, the corresponding coil 95 of the corresponding solenoid 55 is energized by the corresponding driver 94.

Thus, assuming that the second input of all the AND-gates is enabled, if a "1" is instantaneously present in a given stage of the latch register 92, its individual solenoid 55 will be fired. For the instantaneous state illustrated in FIG. 19, the output from the AND-gates 93X will apply an enabling signal to the input of a solenoid driver amplifiers 94X which will issue an output which energizes the coils 95X of the solenoids 55X, causing their respective valve components to admit atmospheric into the corresponding channel as previously described.

The purpose of the array of AND-gates 93 is to effect instrument selection when an individual source of recorded performances, represented by the CD player 90, is connected to a plurality of tracker bar operated musical instruments, each fitted with the invention. In the example, two bits of each frame specify which of four instruments is to be played at the moment. The instrument to be played by the example of the invention for which the electronics module is shown in FIG. 19 requires the logic value "00" in the two highest order bits of the frame, a condition detected by the decoder 96 which enables the AND-gates 93 only if that value is sensed. Other instruments would be respectively responsive to the values "01", "10" and "11". Those skilled in the art will appreciate that a larger selection of instruments can be accommodated by increasing the size of the relevant field in the frame. For example, if the field is expanded to three bits, up to eight different instruments, each fitted with the subject apparatus, can be individually selected. If this feature is omitted, the AND-gates 93 can be omitted such that the individual drivers 94 can be controlled directly from the corresponding individual stages of the latch register 92.

Figure 20:
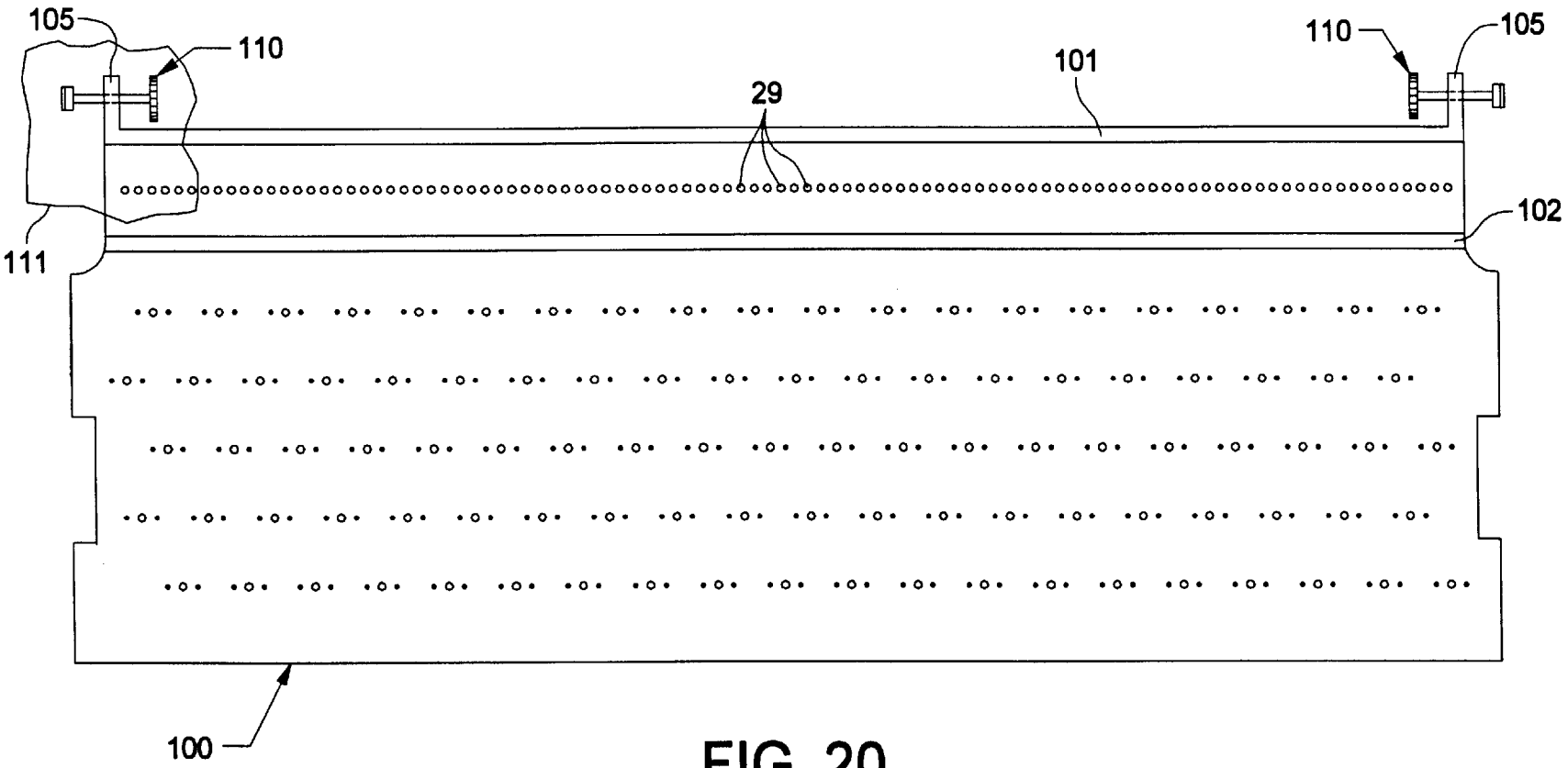
FIG. 20 is a view of the lower face of another version of the channel plate member which includes additional features for both mounting and adjusting the channel plate member into a spool box.
Figure 21:
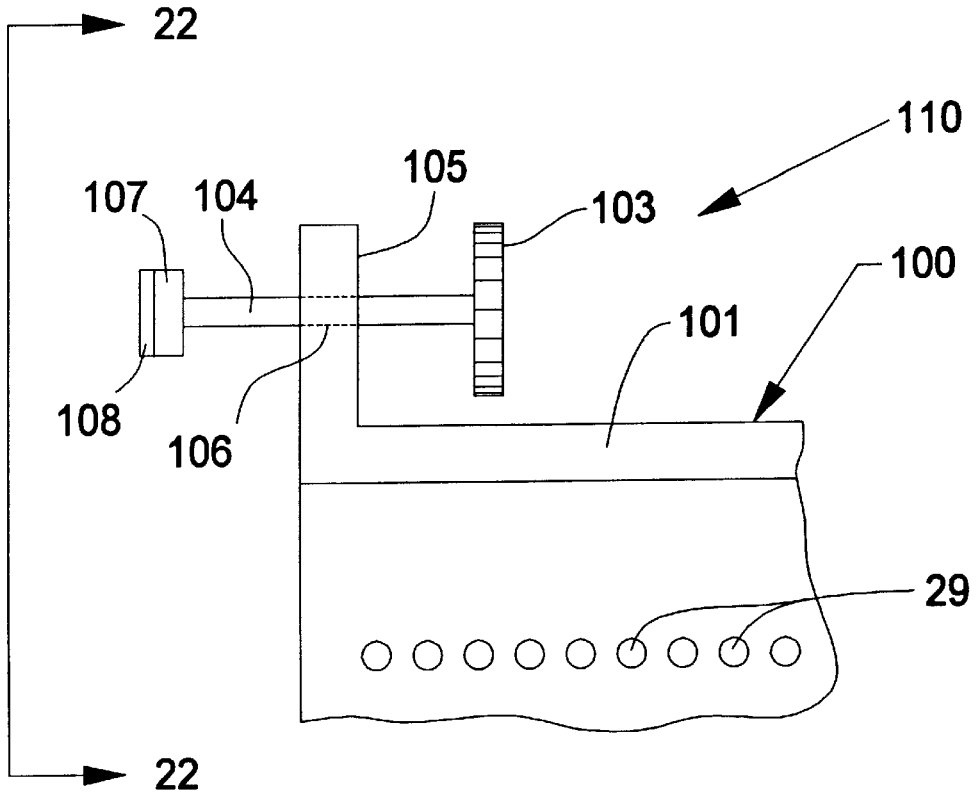
FIG. 21 is a fragmentary view of the channel plate member shown in FIG. 20 and showing details of the additional features.
Figure 22:
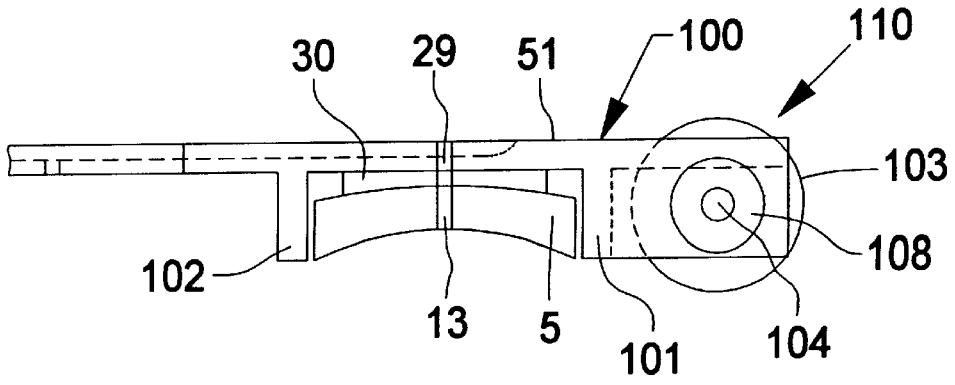
FIG. 22 is a view taken along the lines 22—22 of FIG. 21.

FIGS. 20, 21 and 22 illustrate a third version of the channel plate member component which incorporates certain additional features to facilitate mounting and adjusting the channel plate member to a spool box. Referring to FIG. 21, the channel plate member 100 includes outer 101 and inner 102 walls which extend parallel to and equally spaced on opposite sides of the aligned holes 29 which interface to the tracker bar holes as previously described. The spacing between the walls 101, 102 just exceeds the normal width of a typical tracker bar to ensure close fore-and-aft alignment of the holes 29 to the tracker bar as soon as the channel plate member is mounted to a spool box. In addition, extensions 105 at each end of the outer wall 101 carry lateral adjustment assemblies 110 which facilitate fine side-to-side adjustment.

Details of the lateral adjustment assemblies 110 are best understood with reference to FIG. 21 which is an enlarged fragmentary view of the region 111 in FIG. 20 and FIG. 22 which is a side view taken along the lines 22—22 of FIG. 21. Each adjustment assembly 110 includes a threaded shaft 104 disposed parallel to the outer wall 102 and extending through a threaded hole 106 in the extension 105. An adjustment knob 103 is fixed to the inner end of the shaft 104, and its outer end carries a button 107 of, for example, wood carrying a felt disk 108 on its outer face. The two adjustment assemblies 110 are disposed in mirror image orientation such that the felt disks 108 can be brought to bear against the sidewalls of the spool box and suitably adjusted by manipulating the adjustment knobs 103 to correctly effect side-to-side alignment of the holes 29 in the channel plate member 100 to the tracker bar holes.

Referring particularly to FIG. 22, the relationship of the outer and inner walls, 101, 102 to the tracker bar 5 and the manner in which the walls serve to establish fore-and-aft alignment of the holes 29 in the channel plate member 100 to the holes 13 in the tracker bar 5 will be readily evident.

Figure 23:
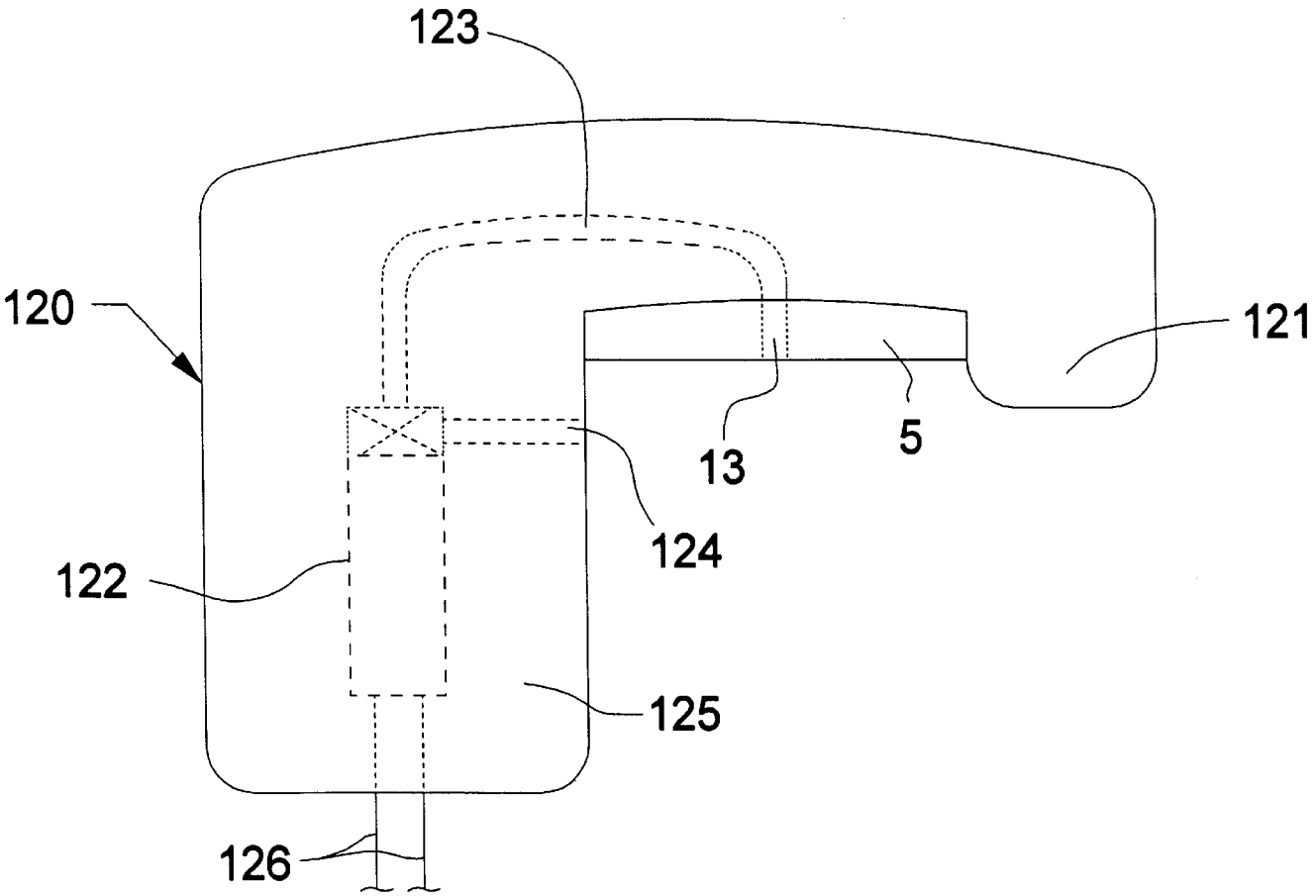
FIG. 23 is a side view of an embodiment of the invention which does not employ a channel plate member.

It has previously been mentioned that a basic principle of the invention is achieving fluid interface between solenoid-operated valves and the holes 13 in the tracker bar to effect systematic switching of each tracker bar hole between atmospheric and closed and that embodiments are contemplated which do not rely upon the use of a channel plate member. Thus, attention is now directed to FIG. 23 which shows in a side view such a variant embodiment which does not require a channel plate member and which is substantially self supporting, once installed, on the tracker bar 5 itself A boot member 120 is configured generally in an inverted L-shape and is fabricated from an elastic material such as natural or synthetic rubber or a resilient plastic. The long leg 125 of the inverted L houses an array of solenoid-operated valves 122, each driven via leads 126 by external circuitry, which communicate individually via internal passages 123 which extend upwardly, then toward the small leg 121, then downwardly to interface directly with the holes 13 in the tracker bar 5. Atmospheric is made available to the solenoid-operated valves 122 via vent passage 124. The distance between the long leg 125 and the short leg 121 of the boot member 120 is established to just receive and elastically engage the tracker bar 5 as shown in FIG. 23 such that, once mounted, the boot member is self supporting but can be readily demounted by lifting either the long leg 125 or the short leg 121 to slightly distort the elastic boot member and permit its removal from the tracker bar 5.

Other embodiments of the invention which do not require the use of a channel plate member are also contemplated. For example, an embodiment similar to that shown in FIG. 23 may use outboard solenoid-operated valves communicating by tubing to passages leading from the end of one of the legs (which may even be of equal length) to interface with the holes 13 of the tracker bar 5.

Thus, while the principles of the invention have now been made clear in illustrative embodiments, there will be immediately obvious to the those skilled in the art many modifications of structure and components used in the practice of the invention which are particularly adapted for specific environments and operating requirements without departing from those principles.

What is claimed is:

1. A system pneumatically coupling a tracker bar operated automatic musical instrument, which includes a spool box having coaxially aligned left and right members for normally receiving and supporting a pay-off spool containing a performance roll, to play electronically recorded performances, said system comprising:

A) a channel plate member having upper and lower faces;

B) a plurality of channels in said channel plate member;

C) first and second holes in each of said channels, said first and second holes extending from each said channel to said lower face of said channel plate member;

D) a plurality of solenoid operated valves, each said solenoid operated valve being adapted to selectively open and close said first hole in one of said channels in response to an energizing signal applied to a solenoid coil, each said solenoid operated valves including:

1) a solenoid; and 2) an armature disc axially movable between first and second positions in said chamber in response to selective energization of said solenoid, said armature disc:

i) when in said first position, closing off said first hole; and ii) when in said second position, open said first hole to atmospheric; and 3) a spring biasing said armature disc toward said first position;

E) a plurality of said second holes in said channels being mutually spaced and oriented to be axially aligned and individually in fluid communication with a corresponding plurality of holes in the tracker bar of the tracker bar operated musical instrument when said channel plate member is juxtaposed in an operating position with respect to the tracker bar;

F) left and right adjustable bracket assemblies adapted to respectively engage said left and right members to juxtapose and maintain said channel plate member in the operating position, each said bracket assembly including:

1) a mounting tab fixed to and downwardly depending from said channel plate member;

2) an elongated adjustment arm including a longitudinal slot and an aperture disposed proximate one end of said adjustment arm;

3) a pivot member for coupling said adjustment arm to said mounting tab through said elongated slot; and 4) fixing means to fix the position of said adjustment arm with respect to said mounting tab; and G) a printed circuit assembly suspended from said lower face of said channel plate member, said printed circuit assembly including driver circuitry for selectively energizing said solenoid operated valves, said solenoids being disposed between and supported by said lower face of said channel plate member and said printed circuit assembly.

2. A system pneumatically coupling a tracker bar operated automatic musical instrument to play electronically recorded performances comprising:

A) a channel plate member having upper and lower faces;

B) a plurality of channels in said channel plate member;

C) first and second holes in each of said channels, said first and second holes extending from each said channel to said lower face of said channel plate member;

D) a plurality of solenoid operated valves, each said solenoid operated valve being adapted to selectively open and close said first hole in one of said channels in response to an energizing signal applied to a solenoid coil;

E) a plurality of said second holes in said channels being mutually spaced and oriented to be axially aligned and individually in fluid communication with a corresponding plurality of holes in the tracker bar of the tracker bar operated musical instrument when said channel plate member is juxtaposed in an operating position with respect to the tracker bar; and F) support means for juxtaposing and maintaining said channel plate member in the operating position with respect to the tracker bar of the tracker bar operated musical instrument.

3. The system of claim 2 in which the automatic musical instrument includes a spool box having coaxially aligned left and right members for normally receiving and supporting a pay-off spool containing a performance roll and in which said support means includes first and second mounting assemblies respectively fixed to and downardly depending from first and second edges of said channel plate member, said mounting assemblies each including coupling means for respectively engaging said left and right members to juxtapose and maintain said channel plate member in the operating position.

4. The system of claim 1 which includes at least one third hole in one of said channels offset from said plurality of second holes in a direction perpendicular to the alignment thereof.

5. The system of claim 2 which includes at least one third hole in one of said channels offset from said plurality of second holes in a direction perpendicular to the alignment thereof.

6. The system of claim 3 which includes at least one third hole in one of said channels offset from said plurality of second holes in a direction perpendicular to the alignment thereof.

7. The system of claim 2 which further includes an armature disc axially movable between first and second positions in said chamber in response to selective energization of said solenoids such that said first hole is closed off when said armature disc is in said first position and said first hole is open to atmospheric when said armature disc is in said second position.

8. The system of claim 2 which further includes an armature disc axially movable between first and second positions in said chamber in response to selective energization of said solenoids to thereby effect one of said solenoid operated valves in which said first hole is closed off when said armature disc is in said first position and said first hole is open to atmospheric when said armature disc is in said second position.

9. The system of claim 7 in which said armature is biased to said first position by a spring.

10. The system of claim 8 in which said armature is biased to said first position by a spring.

11. The system of claim 2 in which each of said support means includes:

A) a mounting tab fixed to and downwardly depending from said channel plate member;

B) an elongated adjustment arm including a longitudinal slot and an aperture disposed proximate one end of said adjustment arm;

C) a pivot member for coupling said adjustment arm to said mounting tab through said elongated slot; and D) fixing means to fix the position of said adjustment arm with respect to said mounting tab.

12. The system of claim 2 in which solenoids included with said solenoid operated valves are disposed between said lower face of said channel plate member and a printed circuit assembly suspended from said lower face of said channel plate assembly.

13. The system of claim 3 in which solenoids included with said solenoid operated valves are disposed between said lower face of said channel plate member and a printed circuit assembly suspended from said lower face of said channel plate assembly.

14. The system of claim 5 in which solenoids included with said solenoid operated valves are disposed between said lower face of said channel plate member and a printed circuit assembly suspended from said lower face of said channel plate assembly.

15. The system of claim 7 in which solenoids included with said solenoid operated valves are disposed between said lower face of said channel plate member and a printed circuit assembly suspended from said lower face of said channel plate assembly.

16. The system of claim 8 in which solenoids included with said solenoid operated valves are disposed between said lower face of said channel plate member and a printed circuit assembly suspended from said lower face of said channel plate assembly.

17. Apparatus for operating a tracker bar operated automatic musical instrument comprising:

A) a plurality of solenoid-operated valves, each solenoid-operated valve having a fluid signal output which is selectively switchable between a first condition in which the fluid signal output is closed and a second condition in which the fluid signal output is atmospheric; and B) conduit means coupling the fluid signal output of each solenoid-operated valve directly to a tracker bar hole.

18. The apparatus of claim 17 in which said conduit means are integrated into a boot member which is configured and dimensioned to fit over and engage a tracker bar such that each of a plurality of said conduit means opens directly into a tracker bar hole.

19. A method of operating a tracker bar operated automatic musical instrument comprising the steps of:

A) providing a plurality of solenoid-operated valves, each solenoid-operated valve having a fluid signal output which is selectively switchable between a first condition in which the fluid signal output is closed and a second condition in which the fluid signal output is atmospheric; and B) coupling the fluid signal output of each solenoid-operated valve directly to a tracker bar hole.

* * * * *